US010493749B2

(12) United States Patent
Yamamuro et al.

(10) Patent No.: US 10,493,749 B2
(45) Date of Patent: Dec. 3, 2019

(54) INKJET PRINTING APPARATUS

(71) Applicant: CANON KABUSHIKI KAISHA, Tokyo (JP)

(72) Inventors: Tomoki Yamamuro, Kawasaki (JP); Atsushi Arai, Yokohama (JP); Masaya Uetsuki, Yokohama (JP); Toshimitsu Danzuka, Tokyo (JP); Kazuo Suzuki, Yokohama (JP); Yoshinori Nakagawa, Kawasaki (JP); Masataka Kato, Yokohama (JP); Tsuyoshi Ibe, Yokohama (JP); Shin Genta, Yokohama (JP); Tatsuaki Orihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 15/796,612

(22) Filed: Oct. 27, 2017

(65) Prior Publication Data

US 2018/0117907 A1 May 3, 2018

(30) Foreign Application Priority Data

Oct. 31, 2016 (JP) ..... 2016-213533

(51) Int. Cl.
*B41J 2/045* (2006.01)
*B41J 2/165* (2006.01)
(Continued)

(52) U.S. Cl.
CPC ..... *B41J 2/04508* (2013.01); *B41J 2/0451* (2013.01); *B41J 2/16505* (2013.01); *B41J 2/16508* (2013.01); *B41J 2/16523* (2013.01); *B41J 2/16526* (2013.01); *B41J 2/1752* (2013.01); *B41J 2/2114* (2013.01); *B41J 29/02* (2013.01); *B41J 29/38* (2013.01); *B41J 29/46* (2013.01); *B41J 2/04566* (2013.01); *B41J 2/16579* (2013.01)

(58) Field of Classification Search
CPC combination set(s) only.
See application file for complete search history.

(56) References Cited

U.S. PATENT DOCUMENTS 7,419,241 B2 * 9/2008 Kawashima ..... B41J 2/1721 347/35
8,899,723 B2 * 12/2014 Suzuki ..... B41J 2/1721 347/36

(Continued)

FOREIGN PATENT DOCUMENTS

JP H06-278290 A 10/1994
JP 2004-167945 A 6/2004

(Continued)

*Primary Examiner* — Thinh H Nguyen
(74) *Attorney, Agent, or Firm* — Canon U.S.A., Inc. I.P. Division

(57) ABSTRACT

A printing apparatus includes a printing head configured to eject a first ink and a second ink, wherein the second ink generates less deposition than the first ink, an ink absorber configured to absorb the ink ejected from the printing head, a detection unit configured to detect a state of the ink absorber through an optical method, and a control unit configured to cause the printing head to eject the second ink to the ink absorber based on a detection result of the detection unit.

20 Claims, 21 Drawing Sheets

(51) Int. Cl.

| | |
|---|---|
| ***B41J 29/46*** | (2006.01) |
| ***B41J 2/175*** | (2006.01) |
| ***B41J 2/21*** | (2006.01) |
| ***B41J 29/02*** | (2006.01) |
| ***B41J 29/38*** | (2006.01) |

(56) References Cited

U.S. PATENT DOCUMENTS

| | | | | |
|---|---|---|---|---|
| 9,162,458 | B2 * | 10/2015 | Mimoto | B41J 2/1433 |
| 2006/0033792 | A1 * | 2/2006 | Sano | B41J 2/1721<br>347/95 |

FOREIGN PATENT DOCUMENTS

| | | | |
|---|---|---|---|
| JP | 2005-028684 | A | 2/2005 |
| JP | 2005-088419 | A | 4/2005 |
| JP | 2007-136830 | A | 6/2007 |
| JP | 2008-229863 | A | 10/2008 |
| JP | 2009-220332 | A | 10/2009 |
| JP | 2012-139856 | A | 7/2012 |
| JP | 2014-076612 | A | 5/2014 |
| JP | 2014-156072 | A | 8/2014 |

* cited by examiner

INKJET PRINTING APPARATUS

BACKGROUND OF THE INVENTION

Field of the Invention

The present disclosure relates to an inkjet printing apparatus.

Description of the Related Art

Japanese Patent Application Laid-Open No. 2004-167945 discloses an apparatus that includes a printing head ejecting ink and a detection unit detecting a height of deposition ink that has been ejected from the printing head and deposited on an absorber. The apparatus performs control to remove the deposition ink when it is detected by the detection unit that the height of the deposition ink is equal to or higher than a predetermined height.

In a case where the height of the deposition ink is detected as with the apparatus disclosed in Japanese Patent Application Laid-Open No. 2004-167945, however, it is necessary for the deposition ink to be deposited to a height detectable by the detection unit, in order to detect the height of the deposition ink. In such a case, in particular, in a case of pigment ink, thickening and solidification of the ink has been progressed, and removal of the deposition ink thereafter may become difficult. To remove the deposition ink that has been solidified, for example, a mechanism to mechanically remove the deposition ink is considered. However, providing a new mechanism may increase the cost and the size of the apparatus. In addition, for example, it is considered that deposition suppression ink (subsequent ink) is ejected with respect to the deposition ink to dissolve the deposition ink, thereby suppressing deposition. In a state where the solidification of the ink has been progressed, however, it is necessary to eject a large amount of subsequent ink in order to dissolve the deposition ink, and consumption of the subsequent ink may be increased.

Further, as another issue, in a case where an amount of ink that exceeds a limit amount held by an ink absorber that contains the ink ejected from the printing head, is ejected to the ink absorber, the ink may be overflowed from the absorber. If the ink is overflowed from the absorber, the overflowed ink may be adhered to a substrate and the like inside a main body of the printing apparatus to cause failure, or the ink may be leaked to the outside of the printing apparatus.

SUMMARY OF THE INVENTION

The present disclosure is directed to an inkjet printing apparatus that makes it possible to early estimate state of an ink absorber with a simple configuration.

According to an aspect of the present disclosure, a printing apparatus includes a printing head configured to eject a first ink and a second ink, wherein the second ink generates less deposition than the first ink, an ink absorber configured to absorb the ink ejected from the printing head, a detection unit configured to detect state of the ink absorber through an optical method, and a control unit configured to cause the printing head to eject the second ink to the ink absorber based on a detection result of the detection unit.

Further features of the present disclosure will become apparent from the following description of exemplary embodiments with reference to the attached drawings.

DESCRIPTION OF THE EMBODIMENTS

An inkjet printing apparatus according to a first exemplary embodiment of the present disclosure is described below with reference to the drawings.

Figure 1:
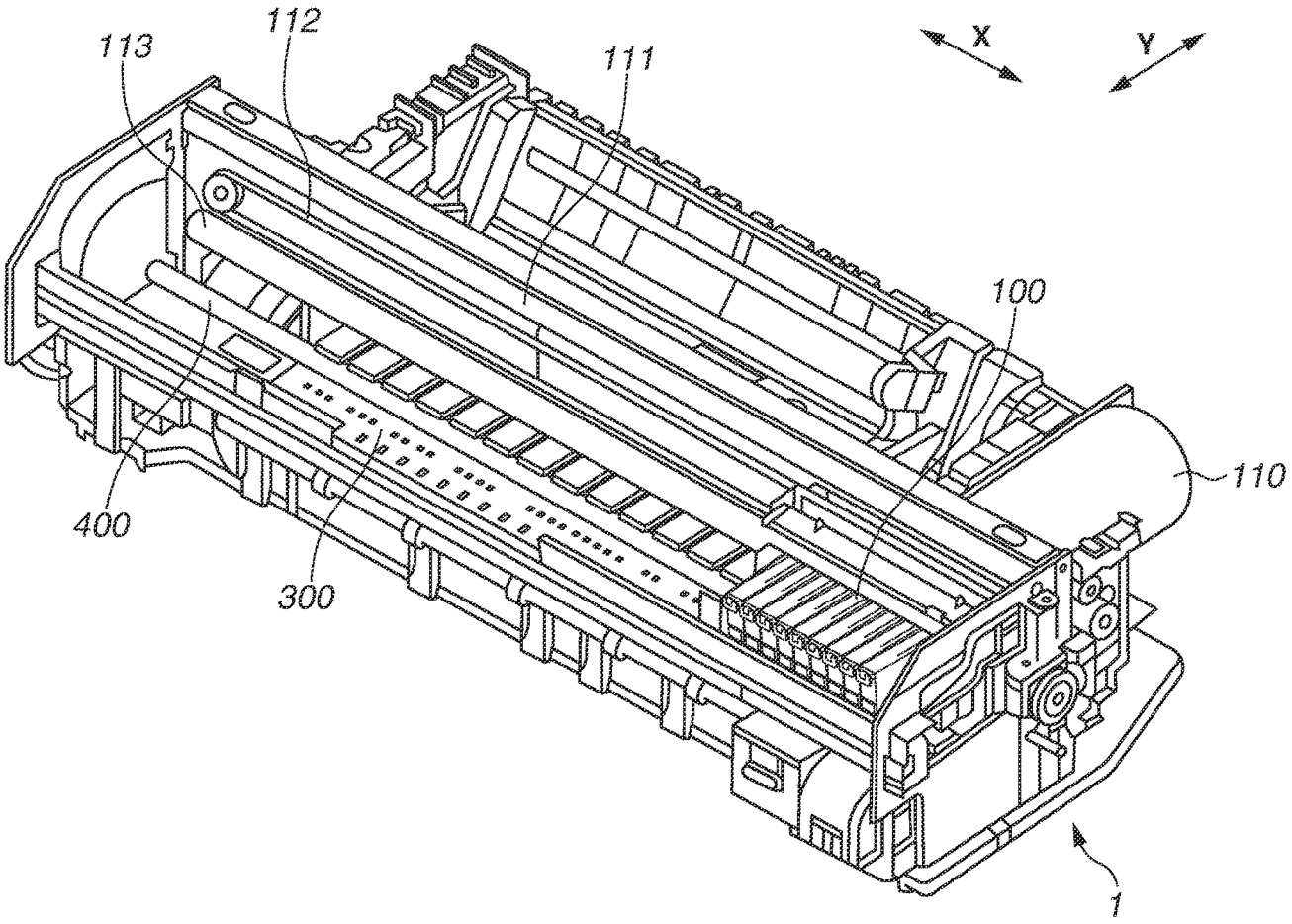
FIG. 1 is a perspective view illustrating an inkjet printing apparatus according to a first exemplary embodiment.

FIG. 1 is a perspective view illustrating the inkjet printing apparatus (a printing apparatus) 1 according to the present exemplary embodiment. The printing apparatus 1 according to the present exemplary embodiment includes a feeding unit, a conveying unit, a printing unit, a discharging unit, a recovery unit, and the like. The feeding unit feeds printing medium (a sheet). The conveying unit conveys the printing medium. The printing unit prints an image on the printing medium. The discharging unit discharges the printing medium on which the image has been printed. The recovery unit recoveries printing performance of the printing unit.

The feeding unit includes a feeding tray and a feeding roller. A plurality of printing media is loaded on the feeding tray. The feeding roller feeds the printing media loaded on the feeding tray to an inside of the printing apparatus one by one.

The conveying unit includes a conveying roller 400 and a pinch roller 401. The conveying roller 400 conveys the printing medium fed from the feeding unit. The pinch roller 401 is disposed at a position facing the conveying roller 400, and holds the printing medium together with the conveying roller 400.

The printing unit includes a printing head 101 and a carriage 100. The printing head 101 includes an ejection port surface 102 provided with an ejection port through which ink is ejected. The printing head 101 is detachably mounted on the carriage 100. The carriage 100 is configured to be reciprocally movable, by driving of a carriage motor 110, in an X direction (a moving direction of the carriage 100) along a guide shaft 113 through a timing belt 112 attached to a chassis 111. The printing medium is conveyed in a Y direction intersecting the X direction. The printing head 101 ejects the ink toward the printing medium that stops at a position facing the printing head 101 to print an image while the carriage 100 reciprocally moves. A platen 300 is provided at the position facing the printing head 101. The platen 300 so supports the printing medium from below as to maintain a constant distance between a surface (a first surface) of the printing medium and the ejection port surface 102 of the printing head 101. A platen absorber (an ink absorber) 301 that absorbs ink ejected to outside of the printing medium is provided on the platen 300.

The discharging unit includes a discharging roller 402 and a spur roller 403. The discharging roller 402 discharges, to outside of the printing apparatus, the printing medium on which the image has been printed. The spur roller 403 presses the printing medium at a position facing the discharging roller 402.

The recovery unit includes a cap 500 that covers the ejection port surface 102 of the printing head 101 outside a printing area in the moving direction of the carriage 100. In addition, the recovery unit includes a suction mechanism in which a suction pump 503 connected to the cap 500 through a tube 502 is driven to suck the ink from the printing head 101 while the cap 500 covers the ejection port surface 2 of the printing head 101. Further, the recovery unit includes a wiper 506 that wipes the ejection port surface 102 of the printing head 101.

Figure 2:
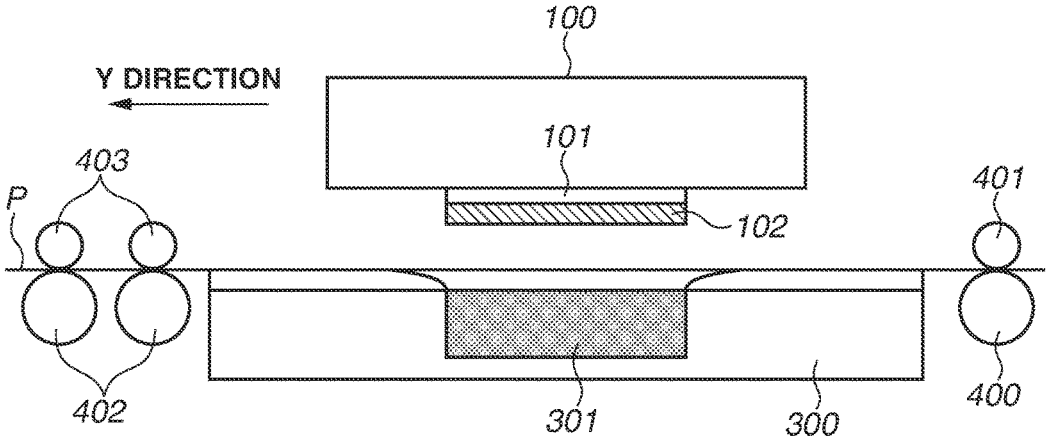
FIG. 2 is a schematic cross-sectional diagram illustrating a periphery of a printing unit according to the first exemplary embodiment.

Next, a configuration of a periphery of the printing unit is described in detail. FIG. 2 is a schematic cross-sectional diagram of the periphery of the printing unit according to the present exemplary embodiment as viewed from the X direction in FIG. 1. A printing medium P fed from the feeding unit is held and conveyed by the conveying roller 400 and the pinch roller 401 that are provided on upstream of the printing head 101 in the Y direction. Further, the printing medium P is also held by the discharging roller 402 and the spur roller 403 that are provided on downstream of the printing head 101 in the Y direction. The printing medium P is held and conveyed while the surface of the recoding medium is maintained in a flat state, in a state where tension occurs between both of the conveying roller 400 and the pinch roller 401 and both of the discharging roller 402 and the spur roller 403. The conveyed printing medium P is supported by the platen 300 from below.

An image of one band (one line) is printed on the conveyed printing medium P, when ink droplets are ejected through the ejection port of the printing head 101 that is mounted on the carriage 100 moving in the X direction while the conveyance of the printing medium P stops. After the image of one band is printed, the conveying roller 400 is driven by an unillustrated conveying motor to convey the printing medium P by a predetermined amount in the Y direction. The reciprocal movement of the carriage 100 and the ejection of the ink droplets by the printing head 101, and the conveyance (intermittent conveyance) of the printing medium P by the predetermined amount by the conveying roller 400 are alternately repeated. As a result, the image of one page is printed on the entire printing medium P.

Figure 3:
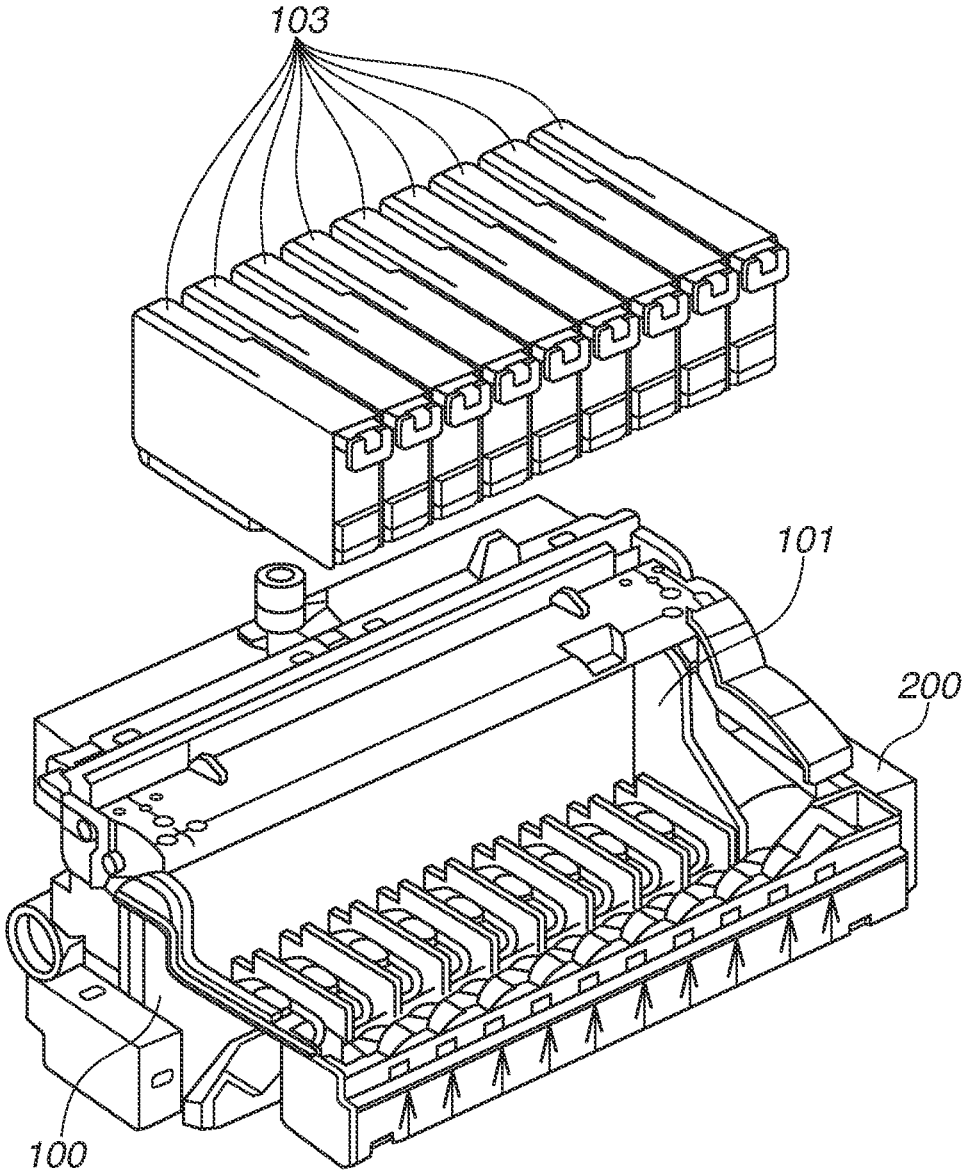
FIG. 3 is a perspective view illustrating a configuration of the printing unit according to the first exemplary embodiment.

FIG. 3 is a perspective view illustrating a configuration of the printing unit according to the present exemplary embodiment. The printing head 101 is detachably mounted on the carriage 100. Further, nine kinds of ink tanks (ink cartridges) 103 are detachably mounted on the printing head 101. The printing apparatus according to the present exemplary embodiment prints an image with use of the nine kinds of inks, and the nine independent ink tanks 103 are attached to the printing head 101. In the present exemplary embodiment, the nine kinds of ink tanks 103 respectively contains (reserves) nine kinds of pigment inks of cyan, magenta, yellow, black, red, light cyan, light magenta, gray, and clear. Moreover, the carriage 100 includes a detection sensor (a detection unit) 200 that includes a light emitting portion 201 and a light receiving portion 202. The light emitting portion 201 emits light. The light receiving portion 202 receives light that has been emitted by the light emitting portion 201 and has been regularly reflected. The detection sensor 200 emits light at a predetermined angle from the light emitting portion 201 toward an inspection target at a predetermined position in the moving direction of the carriage 100, and receives, by the light receiving portion 202, light regularly reflected by the inspection target. The detail of the detection sensor 200 is described later.

Figure 4:
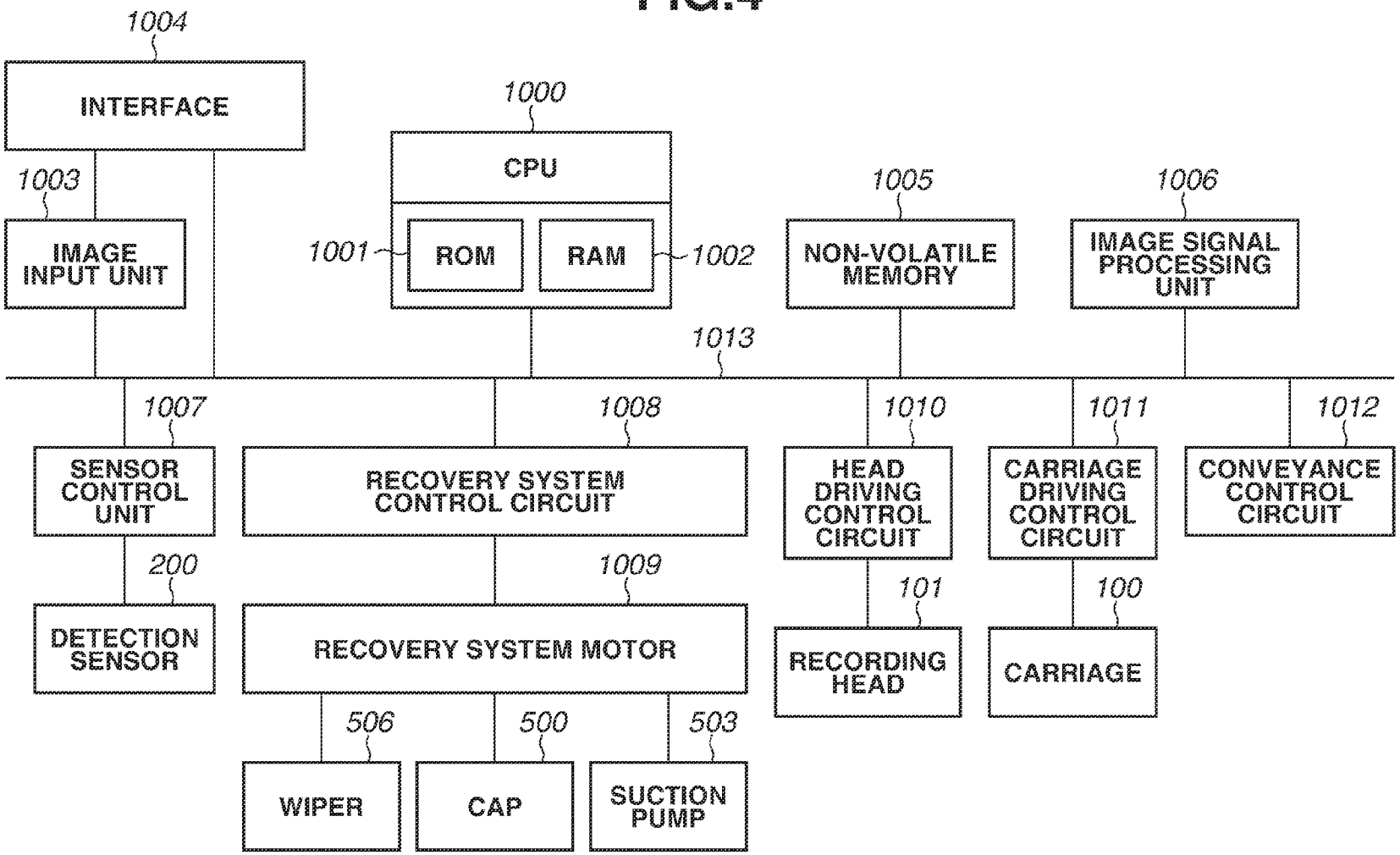
FIG. 4 is a block diagram illustrating a control configuration according to the first exemplary embodiment.

FIG. 4 is a block diagram illustrating a control configuration according to the present exemplary embodiment. In FIG. 4, a central processing unit (CPU) 1000 performs control of each unit in the apparatus through a main bus line 1013 and performs data processing. The CPU 1000 controls the data processing, printing head driving, and carriage driving, and performs printing operation and maintenance operation including preliminary ejection, according to programs stored in a read only memory (ROM) 1001. The CPU 1000 performs communication with a host apparatus through an interface 1004. A random access memory (RAM) 1002 is used as a work area for the data processing and the like by the CPU 1000. The RAM 1002 temporarily holds printing data used for the printing operation, parameters relating to recovery operation and supplying operation of the printing apparatus, and the like. An image input unit 1002 temporarily holds an image provided from the host apparatus through the interface 1004. Further, the CPU 1000 counts ink consumption in suction operation by the recovery unit or the like, and calculates an amount of waste ink contained in a waste-ink storage unit (a waste-ink pack) 504 that contains the waste ink. The CPU 1000 informs the host apparatus and the like of a warning indicating a full state of the waste-ink storage unit 504 or the like, through the interface 1004. A non-volatile memory 1005 holds information relating to the amount of ink contained in the waste-ink storage unit 504, an amount of ink ejected to the platen absorber 301, an ejection time, a kind of ink, and the like. The non-volatile memory 1005 holds the information even when a power source of the printing apparatus is turned off.

A recovery system control circuit 1008 controls drive of a recovery system motor 1009 according to a recovery processing program stored in the RAM 1002. The recovery system control circuit 1008 controls the drive of the recovery system motor 1009, thereby controlling recovery operation (cleaning operation) such as elevating and lowering operation of the cap 500, wiping operation of the wiper 506, and suction operation of the suction pump 503. A head driving control circuit 1010 controls drive for ink ejection of the printing head 101 and causes the printing head 101 to eject the ink for the preliminary ejection and the printing operation. A carriage driving control circuit 1011 controls reciprocal movement of the carriage 100 according to the printing data processed by an image signal processing unit 1006, and controls movement of the carriage 100 to the recovery unit in the recovery operation. A conveyance control circuit 1012 controls drive of the conveying motor according to a program stored in the RAM 1002. The conveyance control circuit 1012 performs control to convey the printing medium by the predetermined amount according to the printing data in order to print the image data of next one band after printing of the image data of one band by the printing head 101 is finished. A sensor control unit 1007 controls the detection sensor 200. The sensor control unit 1007 causes the light emitting portion 201 of the detection sensor 200 to emit light toward the ink absorber and causes the light receiving portion 202 to receive regularly-reflected light, thereby outputting intensity (quantity) of the regularly-reflected light as a voltage value.

Figure 5:
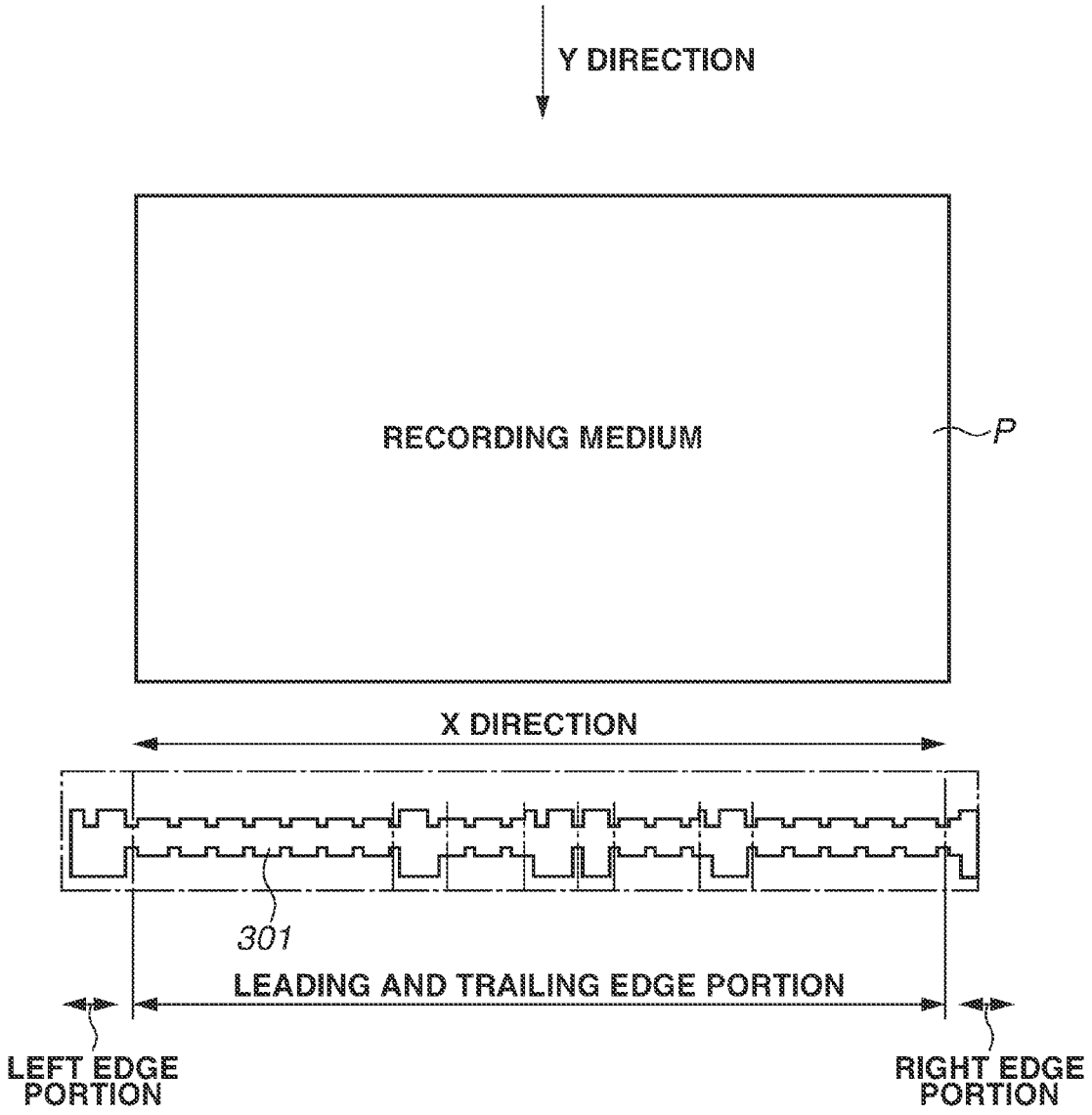
FIG. 5 is a schematic diagram illustrating relationship between a printing medium and an ink absorber when marginless printing is performed in the first exemplary embodiment.

FIG. 5 is a schematic diagram illustrating relationship between the printing medium and the platen absorber in the marginless printing in the present exemplary embodiment. The platen 300 is provided to extend in the moving direction of the carriage 100 in order to support the conveyed printing medium P from below. The printing head 101 ejects ink to a position beyond an edge of the printing medium P (out of die printing medium) in the marginless printing. In addition, to discharge internal thickened ink, the printing head 101 performs preliminary ejection operation to eject, to the outside of the printing medium, ink that does not contribute to printing. The platen absorber 301 that contains the ink ejected protrudedly to the outside of the printing medium is provided in the platen 300. The ink contained in the platen absorber 301 is then discharged from a lower part of the platen 300, and is discharged to (recovered by) the waste-ink storage unit 504 that is provided at a lower part of a main body of the printing apparatus. In the marginless printing in the present exemplary embodiment, the ink is ejected by the printing head 101 up to a region protruded by 3 mm from the size of the printing medium P.

When a predetermined amount or more of the ink that is easily solidified is ejected to the platen absorber 301, the ink may be solidified and deposited on the platen absorber 301. In the present exemplary embodiment, dark color ink such as the magenta ink, the cyan ink, the yellow ink, the black ink, and the red ink among the nine kinds of pigment inks contains a large amount of solid component, is easily solidified, and is difficult to be absorbed by the ink absorber. Accordingly, these inks are classified into "deposition ink" (a first ink group) that is easily deposited on the ink absorber. On the other hand, the ink such as the light cyan ink, the light magenta ink, and the clear ink contains a small amount of solid component, is difficult to be solidified, and is easily absorbed by the ink absorber. These inks are classified into "deposition suppression ink" (a second ink group) that suppresses deposition on the ink absorber because these inks have a function of promoting absorption of the deposited pigment ink. Although the inks are classified into the deposition ink and the deposition suppression ink based on the amount of the solid component in the present exemplary embodiment, the inks may be classified into the deposition ink and the deposition suppression ink based on an amount of solvent or moisturizer contained in the inks. In a case where the deposition suppression ink contains a large amount of solvent or the like, it is possible to suppress increase of viscosity of the deposition ink and to make the deposition ink easy to be absorbed by the ink absorber. Accordingly, pigment ink containing a large amount of solvent or moisturizer may be classified into the deposition suppression ink. Note that the ink used for printing is used as the deposition suppression ink in this example. Alternatively, ink that is not used for printing, for example, ink exclusive for deposition suppression may be ejected, and such ink may be used as the deposition suppression ink.

Figure 6:
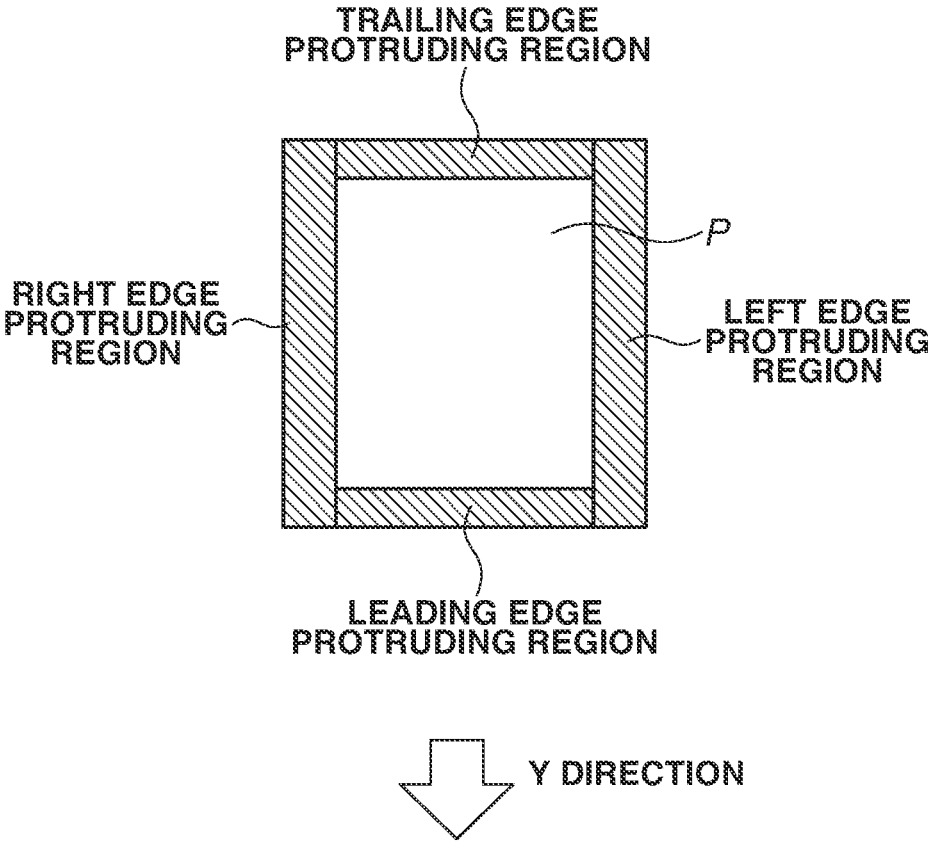
FIG. 6 is a schematic diagram illustrating a count region of deposition ink when the marginless printing is performed in the first exemplary embodiment.

FIG. 6 is a schematic diagram illustrating a count region of the deposition ink in the marginless printing in the present exemplary embodiment. In the present exemplary embodiment, as described above, the ink is ejected also to the regions that are respectively protruded to a leading edge, a trailing edge, a right edge, and a left edge by 3 mm from the region of the printing medium P. In FIG. 6, such a protruding region is illustrated with hatched lines, and the protruding region is classified into a leading edge protruding region, a trailing edge protruding region, a right edge protruding region, and a left edge protruding region. The ink ejected to the right edge protruding region and the left edge protruding region is respectively absorbed by a right edge portion and a left edge portion of the platen absorber 301 illustrated in FIG. 5. In addition, the ink ejected to the leading edge protruding region and the trailing edge protruding region is absorbed by a leading and trailing edge portion of the platen absorber 302 illustrated in FIG. 5. Note that division of the regions is not limited to the above-described example, and the region may be more finely divided in order to improve detection accuracy of a deposited position.

When receiving a printing instruction to perform the marginless printing from the host apparatus, the CPU 1000 calculates the dot number of the deposition ink ejected to the protruding regions. To calculate the dot number of the deposition ink, the dot number of the ink ejected to the right edge portion of the platen absorber 301, the dot number of the ink ejected to the left edge portion, and the dot number of the ink ejected to the leading and trailing edge portion are counted for each kind of the ink. Further, the dot number of the pigment ink serving as the deposition suppression ink is subtracted from the count result of the pigment ink serving as the deposition ink to calculate the deposition dot number. In other words, the following expression is obtainable: the deposition dot number=the dot number of cyan+the dot number of magenta+the dot number of yellow+the dot number of black+the dot number of red−(the dot number of light cyan+the dot number of light magenta+the dot number of gray+the dot number of clear ink).

In the present exemplary embodiment, the information relating the deposition state of the deposition ink in each of the portions of the platen absorber 301 is acquired by calculating the deposition dot number that is a difference between the dot number of the deposition ink and the dot number of the deposition suppression ink. Alternatively, for example, only the dot number of the pigment ink may be simply calculated. Although the number of droplets of the deposition ink is counted in the present exemplary embodiment, the ejection amount of the deposition ink, the ratio thereof, or the like may be calculated.

Figure 9:
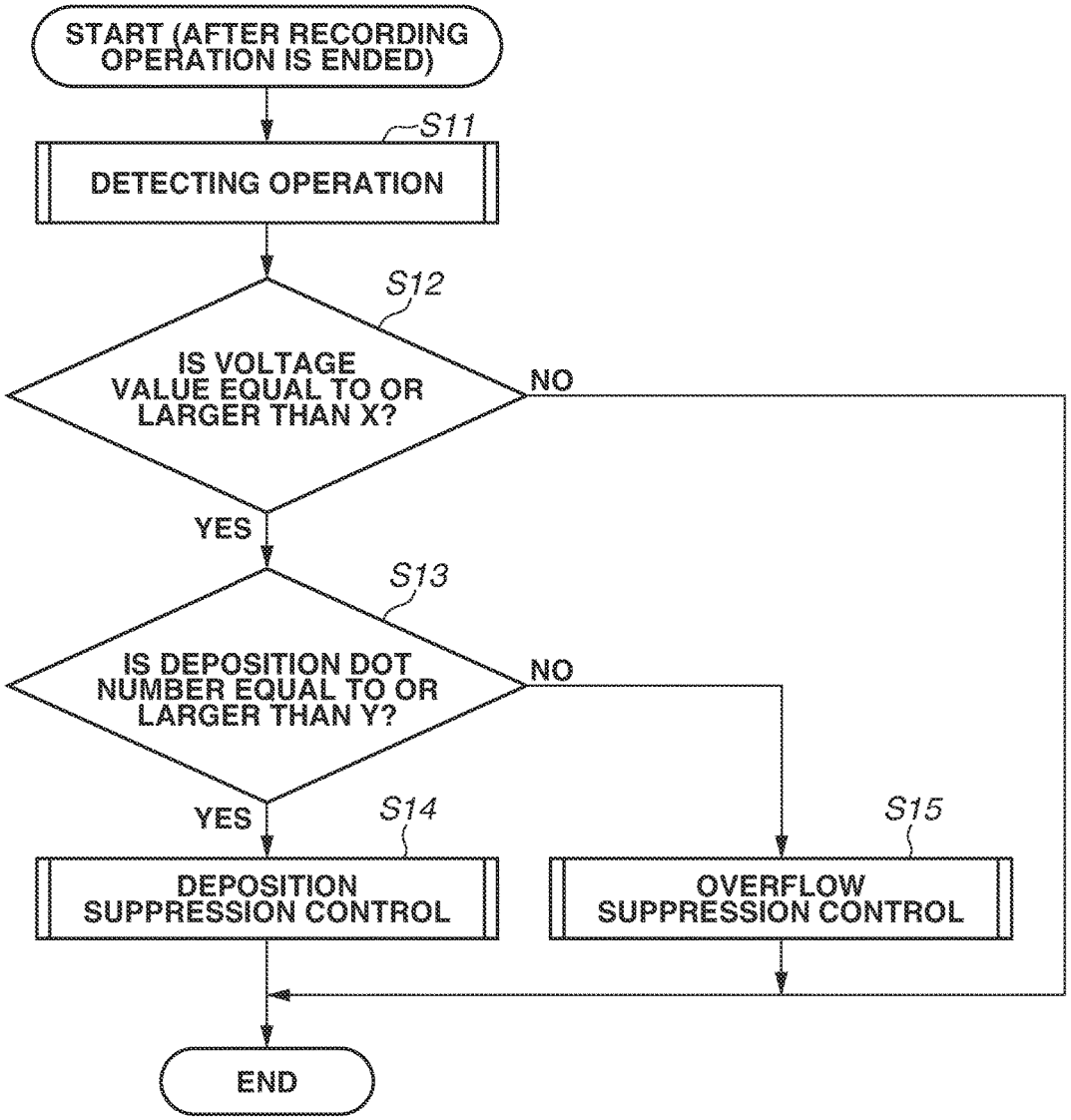
FIG. 9 is a flowchart illustrating control according to the first exemplary embodiment.
Figure 10:
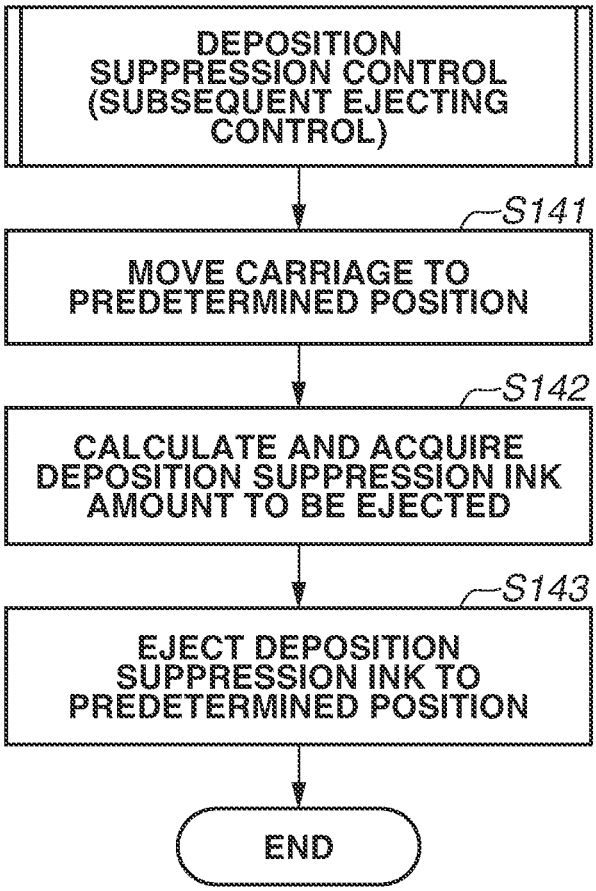
FIG. 10 is a flowchart illustrating deposition suppression control according to the first exemplary embodiment.

The CPU 1000 refers a table that is previously stored in the ROM 1001, thereby determining the ejection number (the dot number) of the deposition suppression ink ejected to each of the portions from the calculated deposition dot number of each of the portions. The deposition dot number and the election number of the deposition suppression ink are used in control described later (FIG. 9 and FIG. 10).

Figure 7:
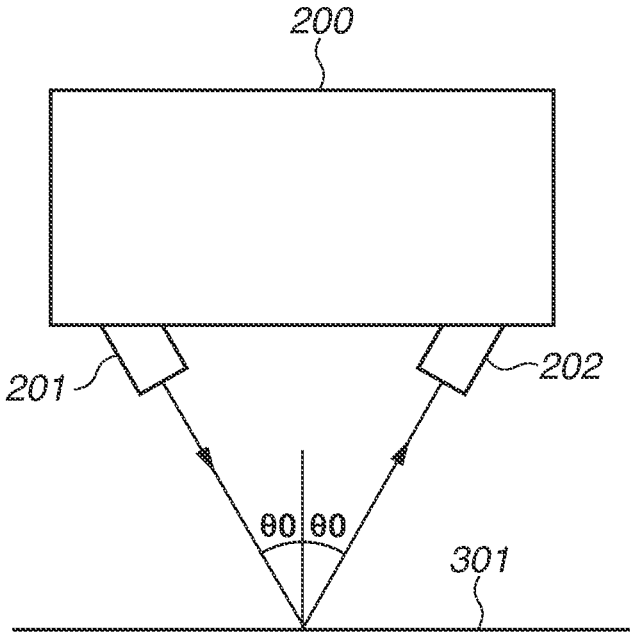
FIG. 7 is a schematic diagram illustrating detecting operation of a detection sensor according to the first exemplary embodiment.

FIG. 7 is a schematic diagram illustrating detecting operation of the detection sensor 200 according to the present exemplary embodiment. The detection sensor 200 is provided in the carriage 100. The detection sensor 200 includes the light emitting portion 201 and the light receiving portion 202. In the present exemplary embodiment, the light emitting portion 201 includes a light-emitting diode (LED) serving as a light source and emits light to the platen absorber 301 at a predetermined incident angle (an angle θ0). The light receiving portion 202 receives light reflected by the platen absorber 301. The light receiving portion 202 is so disposed at a position as to make the incident angle and a reflection angle substantially equal to each other at the angle θ0. A phototransistor included in the light receiving portion 202 largely transmits regularly-reflected light from the light source of the light emitting portion 201. A quantity of the light received by the light receiving portion 202 is calculated inside the detection sensor 200. The detection sensor 200 outputs a higher voltage value as the light quantity is larger.

Figure 8A:
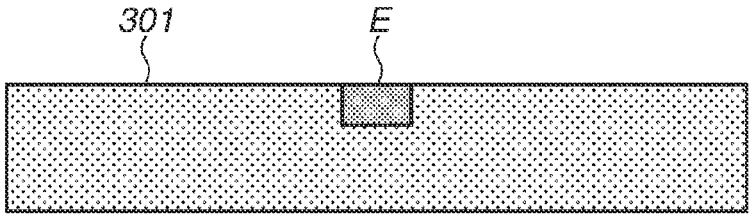
FIGS. 8A and 8B are diagrams illustrating an output result of the detection sensor according to the first exemplary embodiment.
Figure 8B:
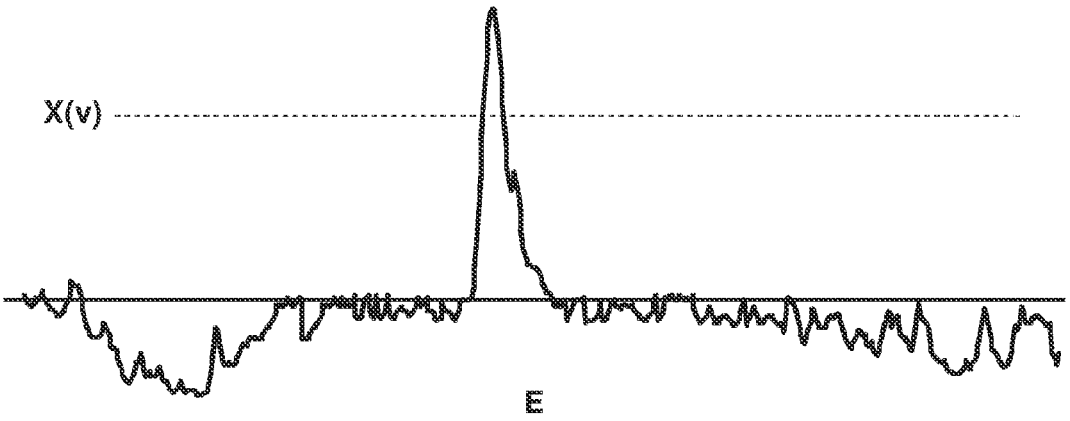

FIGS. 8A and 8B are diagrams illustrating output result of the detection sensor 200 according to the present exemplary embodiment. When the ink is deposited on the platen absorber 301, the ink is first solidified inside the platen absorber 301 and the surface of the platen absorber 301 is gradually filled with the ink (deposition symptom). When the platen absorber 301 becomes unable to absorb the ink after the deposition symptom appears, deposition of the ink starts. FIG. 8A is a schematic diagram illustrating a state in which the deposition symptom appears at a predetermined position E on the platen absorber 301, and FIG. 8B is a graph indicating the output result of the detection sensor 200 at positions corresponding to FIG. 8A. In the graph, voltage values that are output values of the detection sensor 200 when the light receiving portion 202 of the detection sensor 200 receives the regularly-reflected light from the respective positions on the platen absorber 301 are illustrated. In the graph, a peak of the voltage value is observed at the predetermined position E at which the deposition symptom appears, and the voltage value at the predetermined position E becomes a value larger than a threshold X (v). This is because, at the position at which the deposition symptom appears, irregularity of the surface of the ink absorber is filed with the solidified ink, smoothness of the surface of the platen absorber 301 is changed to increase glossiness, and intensity of the regularly-reflected light is accordingly enhanced as compared with the periphery. As described above, the deposition symptom of the ink on the platen absorber 301 is distinguished through detection of the intensity (the quantity) of the regularly-reflected light. In addition, overflow of the ink from the platen absorber 301 is similarly distinguished through detection of the intensity (the quantity) of the regularly-reflected light because the smoothness of the surface of the platen absorber 301 is changed when the inside of the platen absorber 301 is filled with the ink. As described above, the detecting operation makes it possible to detect, through measurement of the glossiness of the platen absorber 301, whether the platen absorber 301 is in an abnormal state, i.e., whether deposition or overflow of the ink has occurred on the platen absorber 301.

Next, the control according to the present exemplary embodiment in the configuration of the printing apparatus described above is described with reference to a flowchart. FIG. 9 is a flowchart illustrating processes according to the present exemplary embodiment, from the detecting operation is performed on the ink absorber to execution of deposition suppression control or overflow suppression control. The control is started after the printing operation is ended. First, in step S11, the carriage 100 moves above the protruding region on the platen absorber 301 to perform the detecting operation by the detection sensor 200. In other words, the light emitting portion 201 emits light at the predetermined angle θ0 at the respective positions above the platen absorber 301, and the light receiving portion 202 receives the regularly-reflected light. In step S12, the quantity of the received light is converted into a voltage value and the voltage value is outputted, and whether the voltage value is equal to or larger than the threshold X (v) is determined. In a case where it is determined that the voltage value is equal to or larger than the threshold X (v) (Yes in step S12), the processing proceeds to step S13. Note that the determination whether the voltage value is equal to or larger than the threshold X (v) at this time may be performed through determination whether a difference between an output value detected at an early time and an output value detected at this time is equal to or larger than the threshold, or comparison with a detection value of the platen absorber that has been previously measured, evaluated in error, and stored.

In step S13, whether the deposition dot number of the ink ejected to the protruding region, counted at a time when the printing instruction is received, is equal to or larger than a predetermined value Y (dot) at the position at which the voltage value is equal to or larger than the threshold X (v) is determined. In a case where it is determined that the deposition dot number is equal to or larger than the predetermined value Y (dot) (YES in step S13), deposition symptom is estimated to be present, and the processing proceeds to step S14. In step S14, the deposition suppression control described later is performed. On the other hand, in a case where it is determined that the deposition dot number is lower than the predetermined value Y (dot) (NO in step S13), overflow of the ink is estimated to be present, and the processing proceeds to step S15. In step S15, the overflow suppression control described later is performed. Note that the method of distinguishing the deposition and the overflow of the ink is not limited to the above-described method using the dot count. For example, since it is known that the deposition of the ink is often influenced by humidity and the deposition easily occurs at low humidity, a humidity sensor may detect the humidity of the environment in which the printing apparatus is placed, and occurrence of not deposition but overflow may be estimated when the detected humidity is equal to or higher than predetermined humidity. The control based on the detection result of the humidity in the above-described manner is also possible.

Next, the deposition suppression control according to the present exemplary embodiment is described. FIG. 10 is a flowchart illustrating the deposition suppression control according to the present exemplary embodiment. The deposition suppression control is performed in step S14 in FIG. 9. In the present exemplary embodiment, subsequent ejecting control in which the deposition suppression ink is ejected with respect to the deposition ink is described as an example of the deposition suppression control. In step S141 in FIG. 10, the carriage 100 moves to a region that includes the predetermined position at which the voltage value detected by the detection sensor 200 is equal to or larger than the threshold X (v). In step S142, the dot number of the deposition suppression ink previously calculated is acquired. More specifically, the dot number of the deposition suppression ink is calculated by multiplying the deposition dot number acquired in step S13 by a predetermined coefficient B in the following expression: the dot number of the deposition suppression ink to be ejected=B×the deposition dot number.

The coefficient B is a coefficient set by previously studying and evaluating effects when the deposition suppression ink is ejected with respect to the deposition ink. In this example, the coefficient B is calculated by assuming proportional relation between the deposition dot number and the dot number of the deposition suppression ink to be ejected. Since the deposition of the ink has large environmental dependency, the coefficient B may be a coefficient that is varied depending on environment such as temperature and humidity. Although, in the present exemplary embodiment, the deposition dot number and the dot number of the deposition suppression ink to be ejected are previously calculated and acquired from printing data before the printing operation, the deposition dot number and the dot number of the deposition suppression ink to be ejected may be calculated after the printing operation or may be calculated in, for example, step S142. In step S143, the deposition suppression ink is ejected by the ejection amount of the deposition suppression ink acquired in step S142. At this time, in a case where the deposition ink is detected over a wide portion on the platen absorber 301 such as the leading and trailing edge portion in FIG. 5, the deposition suppression ink may be ejected while the carriage 100 is reciprocally moved a plurality of times. Further, in a case where the region in which the deposition ink is detected is small, the carriage 100 may be stopped above the detected region and the deposition suppression ink may be ejected. When the ejection of the deposition suppression ink is finished, the deposition suppression control that is the subsequent ejecting control is ended.

In the present exemplary embodiment, the deposition suppression of the ink ejected to the protruding region of the platen absorber in the marginless printing is described. Furthermore, the present disclosure may be applied to deposition suppression of the ink ejected to the platen absorber in preliminary ejection, deposition suppression of the ink ejected to a preliminary ejection receiver in the preliminary ejection, deposition suppression of the ink ejected to the cap in the preliminary ejection, and the like. In addition, as the deposition suppression control, display to prompt cleaning with respect to deposition, restriction or prohibition of the marginless printing, warning/error display, or the like may be performed.

Figure 11:
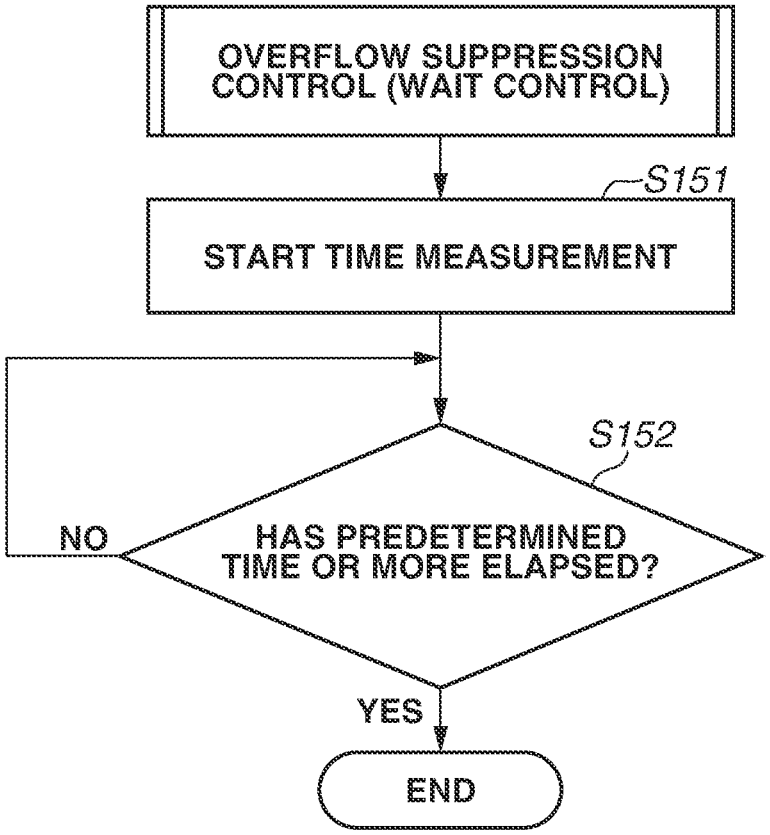
FIG. 11 is a flowchart illustrating overflow suppression control according to the first exemplary embodiment.

Next, the overflow suppression control according to the present exemplary embodiment is described. FIG. 11 is a flowchart illustrating the overflow suppression control according to the present exemplary embodiment. The overflow suppression control is performed in step S15 in FIG. 9. In the present exemplary embodiment, wait control to wait for a predetermined time before the printing operation is described as an example of the overflow suppression control. In step S151 in FIG. 11, an unillustrated time measurement unit starts time measurement in seconds. In step S152, waiting is performed until the measurement time exceeds a predetermined time. At this time, even if next printing instruction is received, the printing operation is not started. When the predetermined time is elapsed (YES in step S152), the overflow suppression control is ended. Performing the above-described operation causes the ink that is temporarily overflowed at the predetermined position on the platen absorber to permeate the lower part and the periphery of the platen absorber, which enables start of the next printing operation in a state where the ink overflow is eliminated.

Although, in the present exemplary embodiment, the waiting for the predetermined time is performed before the printing, the waiting for the predetermined time may be performed every time printing of one line is finished during the next printing operation. In addition, if the predetermined position at which it is estimated that overflow of the ink may have occurred is coincident with the preliminary ejection position at which the preliminary ejection is performed, the overflow of the ink may be suppressed by, for example, setting, for delay, the ejection frequency in the preliminary ejection smaller than a predetermined value to take a long time to perform the ejection. In addition, if the predetermined position is coincident with the preliminary ejection position, for example, the ejection position may be changed to an adjacent position on the platen absorber at which overflow of the ink has not occurred. Further, if a pump communicates with the lower part of the platen absorber and the waste ink is discharged through drive of the pump, the ink inside the platen absorber may be discharged through drive of the pump to suppress overflow of the ink.

Although, in the present exemplary embodiment, the detection sensor is provided in the carriage, the position of the detection sensor is not limited thereto. The detection sensor may be provided at an optional position as long as the detection sensor emits light to the platen absorber and the preliminary ejection receiver, and easily detects the regularly-reflected light. For example, the detection sensor may be fixed to a position right above the protruding region in the marginless printing.

As described above, according to the present exemplary embodiment, symptom of the deposition or the overflow of the ink on the ink absorber is detected with high accuracy through the simple configuration, which makes it possible to suppress the deposition or the overflow of the ink.

Next, a second exemplary embodiment of the present disclosure is described with reference to the drawings. Description of a component similar to that of the first exemplary embodiment is omitted.

As described above, the recovery unit is disposed on the lower part of the carriage 100 in FIG. 1 (out of the printing region in the moving direction of the carriage 100). The recovery unit performs recovery operation on the printing head 101 at predetermined timing such that the printing head 101 normally eject the ink through the ejection port.

Figure 12:
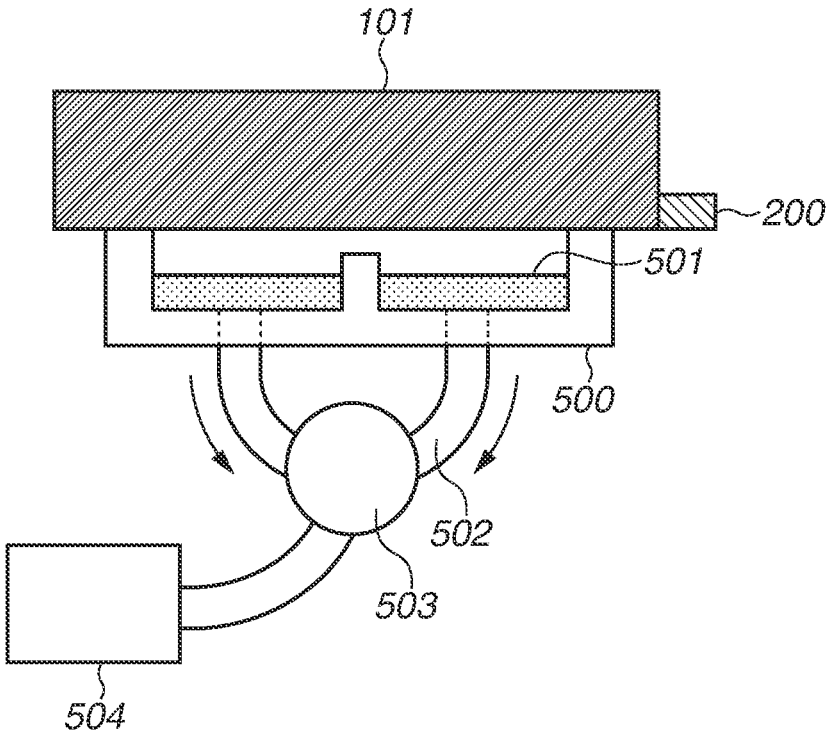
FIG. 12 is a schematic diagram illustrating a recovery unit according to a second exemplary embodiment.

FIG. 12 is a schematic diagram of the recovery unit according to the present exemplary embodiment. As described above, the recovery unit includes a cap 500 that covers the ejection port surface 102 of the printing head 101 in various kinds of recovery operation. In the cap 500, a cap absorber (an ink absorber) 501 is provided at a position facing the ejection port surface 102 of the printing head 101. The cap absorber 501 and the ejection port surface 102 of the printing head 101 have a minute space therebetween. The cap 500 communicates, at a lower part thereof, with the suction pump 503 through the tube 502. When the suction pump 503 is driven, negative pressure occurs in the space between the printing head 101 and the cap 500, and the ink is sucked through the suction port of the printing head 101. The sucked ink is discharged to the waste-ink storage unit 504 connected through the tube 502. As described above, sucking the ink through the ejection port of the printing head 101 makes it possible to prevent ink solidification, mixing of bubbles, and the like in the printing head 101.

Figure 13:
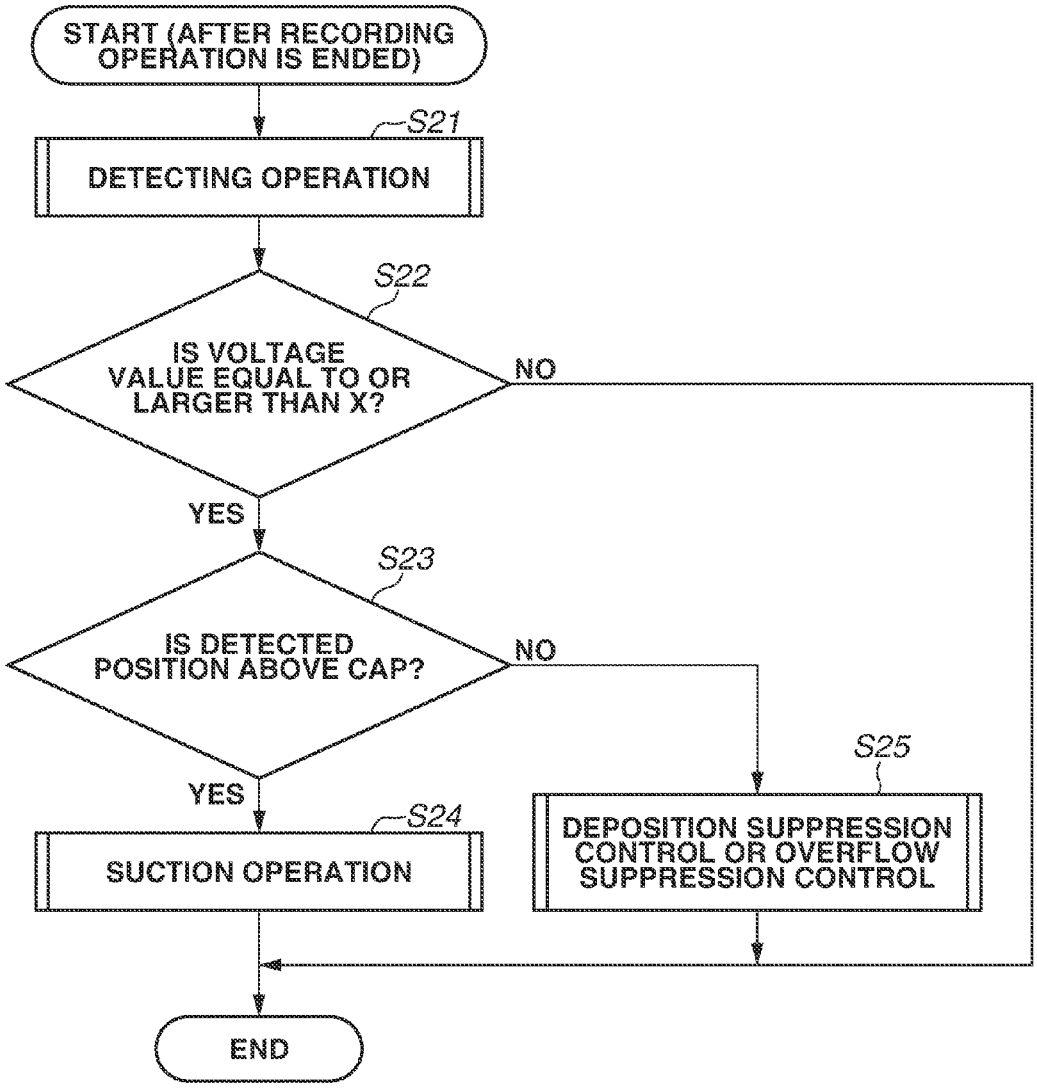
FIG. 13 is a flowchart illustrating control according to the second exemplary embodiment.

Next, the control according to the present exemplary embodiment is described with reference to a flowchart of FIG. 13. This control is started after the printing operation is ended. In step S21 in FIG. 13, the detecting operation by the above-described detection sensor is performed on the platen absorber (a first ink absorber) provided on the platen and the cap absorber 501 (a second ink absorber) provided on the cap 500. In step S22, whether the voltage value as the output result of the detection sensor in the detecting operation is equal to or larger than the threshold X (v) is determined. In a case where it is determined that the voltage value is equal to or larger than the threshold X (v) (YES in step S22), the processing proceeds to step S23. In step S23, whether the detected position at which the detected voltage value is equal to or larger than the threshold X (v) is coincident with a position above the cap 500 (above the cap absorber 501) is determined. The detected position is detected through detection of a position in the moving direction of the carriage by an unillustrated encoder that is provided in an extension line of a guide shaft 113 in the X direction. In a case where it is determined that the detected position is above the cap 500 in step S23 (YES in step S23), the processing proceeds to step S24. In step S24, the cap 500 is brought into contact with the printing head 101 and the suction pump 503 is driven to make the inside pressure negative while the cap 500 covers the ejection port surface 102 of the printing head 101, which causes the suction operation to suck the ink through the ejection port of the printing head 101. In the suction operation, the deposition ink on the cap absorber 501 is immersed in the ink sucked through the ejection port of the printing head 101 and is dissolved, and the ink inside the cap absorber 501 is discharged to the waste-ink storage unit 504. In other words, the suction operation eliminates the deposition and the overflow of the ink in the cap absorber 501.

On the other hand, in a case where it is determined that the detected position is not above the cap 500 (above the cap absorber 501), i.e., above the platen (above the platen absorber) in step S23 (NO in step S23), the processing proceeds to step S25. In step S25, the deposition suppression control or the overflow suppression control is performed at the predetermined position on the platen absorber 301. These control are similar to the control described in the first exemplary embodiment.

As described above, according to the present exemplary embodiment, deposition and overflow of the ink in the cap absorber 501 is eliminated by the suction operation, which makes it possible to reduce time necessary for the deposition suppression control and the overflow suppression control. In addition, in the case where the subsequent ejecting control is performed as the deposition suppression control, it is possible to reduce the waste ink amount of the deposition suppression ink required for the subsequent electing control.

Next, a third exemplary embodiment of the present disclosure is described with reference to the drawings. Description of a component similar to that of any of the above-described exemplary embodiments is omitted.

Figure 14:
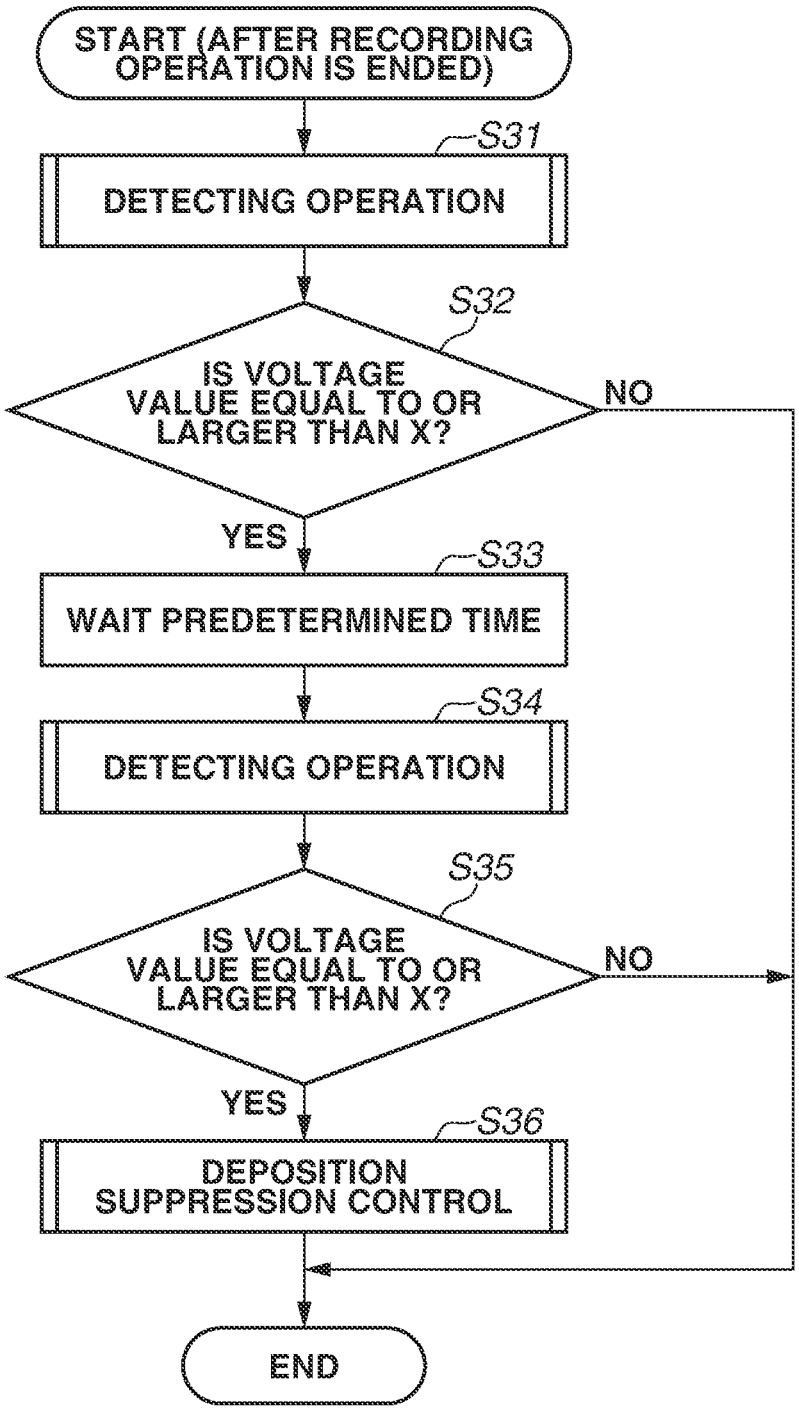
FIG. 14 is a flowchart illustrating control according to a third exemplary embodiment.

The control according to the present exemplary embodiment is described with reference to a flowchart of FIG. 14. This control is started after the printing operation is ended. First, in step S31, the detecting operation by the detection sensor is performed similarly to the first exemplary embodiment. In step S32, whether the voltage value as the output result of the detection sensor in the detecting operation in step S31 is equal to or larger than the threshold X (v) is determined. In a case where it is determined that the voltage value is equal to or larger than the threshold X (v) (YES in step S32), the processing proceeds to step S33. In step S33, waiting is performed until a predetermined time T (s) is elapsed (wait). After waiting for the predetermined time T (s), detecting operation by the detection sensor is performed again in step S34. Then, in step S35, whether the voltage value as the output result of the detection sensor in the detecting operation performed again in step S34 is equal to or larger than the threshold X (v) is determined. In a case where it is determined that the voltage value is equal to or larger than the threshold X (v) (YES in step S35), the processing proceeds to step S36 and the deposition suppression control is performed. The deposition suppression control is similar to the deposition suppression control in the first exemplary embodiment. In a case where the voltage value is lower than the threshold X (v) in step S32 or step S35 (NO in step S32 or S35), this control is ended without performing the deposition suppression control.

In the control according to the present exemplary embodiment, after waiting for the predetermined time after the detecting operation by the detection sensor is performed, the detecting operation by the detection sensor is performed again. In a case where the detection result is caused by the overflow of the ink at the detected position at which the voltage value detected by the detection sensor is equal to or larger than the threshold X (v), it is considered that the ink temporarily overflowed in the waiting for the predetermined time permeates the periphery and the overflow is accordingly stopped. Further, it is considered that the voltage value as the detection result becomes lower in the detecting operation performed again. On the other hand, in a case where the detection result is caused by the deposition of the ink, the detection result at the detected position is not changed even after waiting for the predetermined time. The detecting operation is performed again after the waiting for the predetermined time in the above-described manner makes it possible to distinguish whether deposition or overflow of the ink occurs at the detected position.

As described above, according to the present exemplary embodiment, the detecting operation is performed twice at predetermined timing, which makes it possible to distinguish deposition or overflow of the ink at the detected position of the ink absorber, and further to suppress deposition and overflow of the ink through simple control from which the overflow suppression control is omitted.

Next, a fourth exemplary embodiment of the present disclosure is described with reference to the drawings. Description of a component similar to that of any of the above-described exemplary embodiments is omitted.

Figure 15:
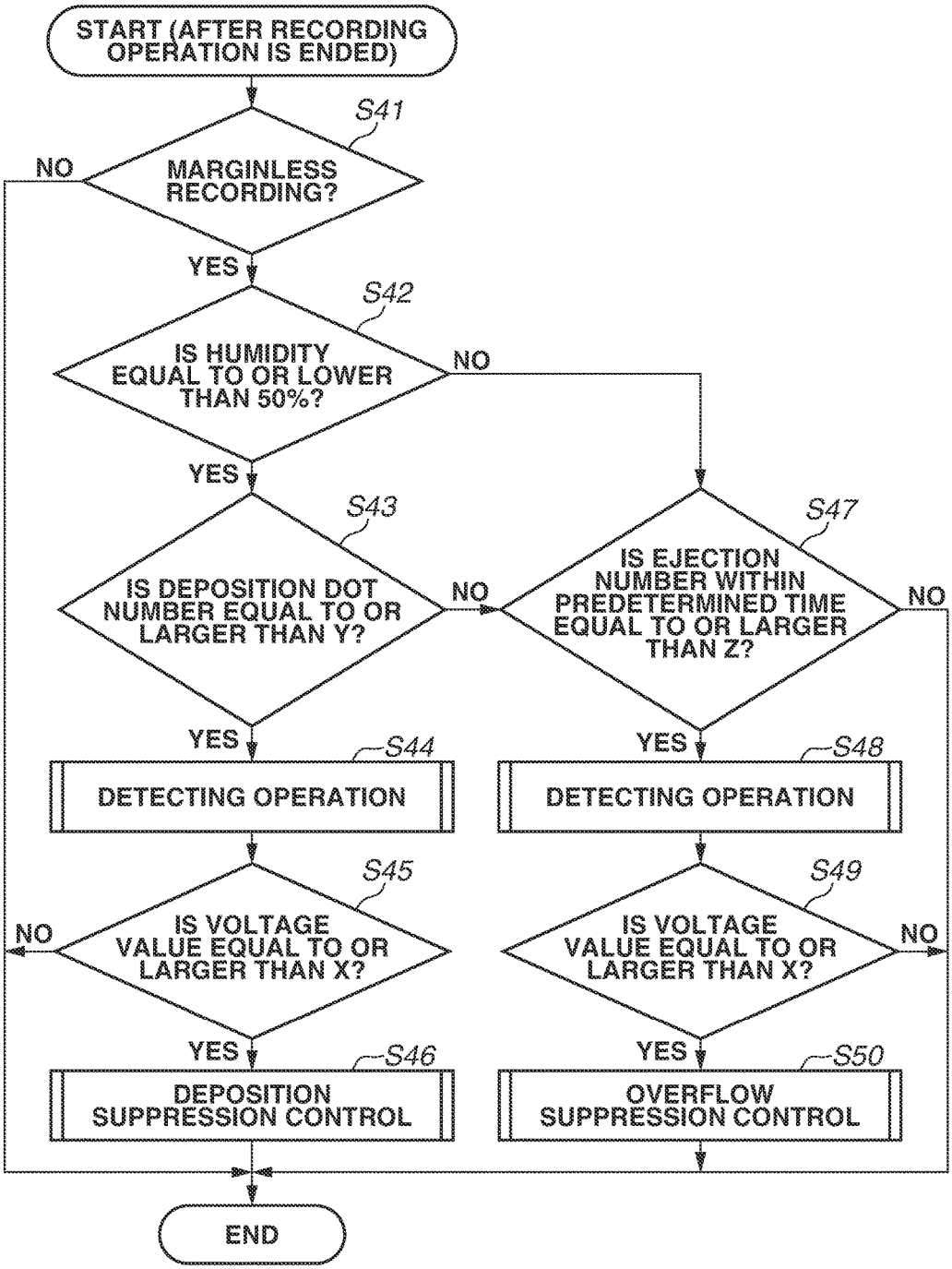
FIG. 15 is a flowchart illustrating control according to a fourth exemplary embodiment.

The control according to the present exemplary embodiment is described with reference to a flowchart of FIG. 15. This control is started after the printing operation is ended. First, in step S41, it is determined from the printing data whether the printing operation has been the marginless printing. In a case of the marginless printing (YES in step S41), the processing proceeds to step S42. In step S42, an unillustrated humidity sensor measures humidity of the environment in which the printing apparatus is placed, and whether the measured humidity is equal to or lower than predetermined humidity is determined. In a case where it is determined that the humidity is equal to or lower than the predetermined humidity in step S42 (YES in step S42), the processing proceeds to step S43. In step S43, whether the deposition dot number of the ink ejected to the protruding region is equal to or larger than a predetermined value Y is determined. The method of calculating the deposition dot number is similar to the method in the first exemplary embodiment. In a case where it is determined that the deposition dot number is equal to or larger than the predetermined value Y in step S43 (YES in step S43), it is estimated that deposition of ink has occurred, and the processing proceeds to step S44 and the detecting operation by the detection sensor is performed. Then, in step S45, whether the voltage value as the output result of the detection sensor in the detecting operation in step S44 is equal to or larger than the threshold X (v) is determined. In a case where it is determined that the voltage value is equal to or larger than the threshold X (v) (YES in step S45), the processing proceeds to step S46 and the deposition suppression control is performed. The deposition suppression control is similar to the deposition suppression control in the first exemplary embodiment.

On the other hand, in a case where the humidity is larger than the predetermined humidity in step S42 (NO in step S42) or in a case where the deposition dot number is smaller than the predetermined value Y in step S43 (NO in step S43), the processing proceeds to step S47. In step S47, whether a predetermined amount or more of ink has been ejected within a predetermined time is determined. In a case where it is determined that the predetermined amount or more of ink has been ejected within the predetermined time in step S47 (YES in step S47), it is estimated that overflow of the ink has occurred, and the processing proceeds to step S48 and the detecting operation by the detection sensor is performed. Then, in step S49, whether the voltage value as the output result of the detection sensor in the detecting operation in step S48 is equal to or larger than the threshold X (v) is determined. In a case where it is determined that the voltage value is equal to or larger than the threshold X (v) (YES in step S49), the processing proceeds to step S50 and the overflow suppression control is performed. The overflow suppression control is similar to the overflow suppression control in the first exemplary embodiment.

As described above, according to the present exemplary embodiment, it is estimated that deposition or overflow of the ink may have occurred in the ink absorber before the detecting operation. Since the detecting operation is performed after the estimation, it is possible to reduce opportunity of performing the detecting operation and to reduce the waiting time.

Next, a fifth exemplary embodiment of the present disclosure is described with reference to the drawings. Description of a component similar to that of any of the above-described exemplary embodiments is omitted.

Figure 16A:
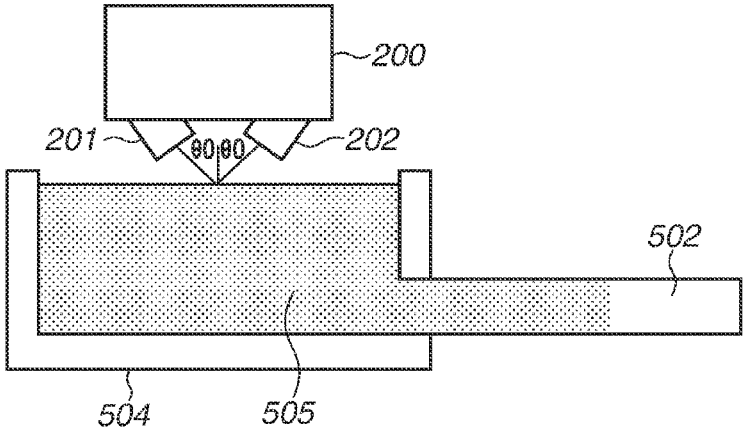
FIGS. 16A, 16B, and 16C are schematic diagrams illustrating detecting operation by detection sensor according to a fifth exemplary embodiment.

As described with reference to FIG. 12 in the second exemplary embodiment, the cap 500 communicates with the suction pump 503 and the waste-ink storage unit 504 through the tube 502. When the suction pump 503 is driven in the suction operation, the ink is sucked through the ejection port of the printing head 101. The sucked ink is discharged to the waste-ink storage unit 504. FIG. 16A is a schematic diagram illustrating the waste-ink storage unit 504 according to the present exemplary embodiment. A waste-ink absorber (an ink absorber) 505 is provided inside the waste-ink storage unit 504. The waste-ink absorber 505 holds a predetermined amount of the waste ink discharged through the tube 502.

In the present exemplary embodiment, the detection sensor 200 that detects deposition or overflow of the ink in the waste-ink absorber 505 provided in the waste-ink storage unit 504, is disposed above the waste-ink storage unit 504. The detection sensor 200 includes the light emitting portion 201 emitting light and the light receiving portion 202 receiving light. The light emitting portion 201 emits light to the waste-ink absorber 505 at the predetermined angle θ0, and the light receiving portion 202 receives the regularly-reflected light from the waste-ink absorber 505.

Figure 16B:
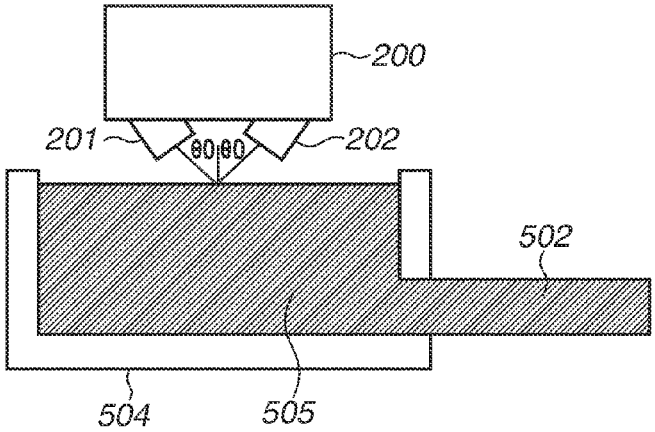
Figure 17:
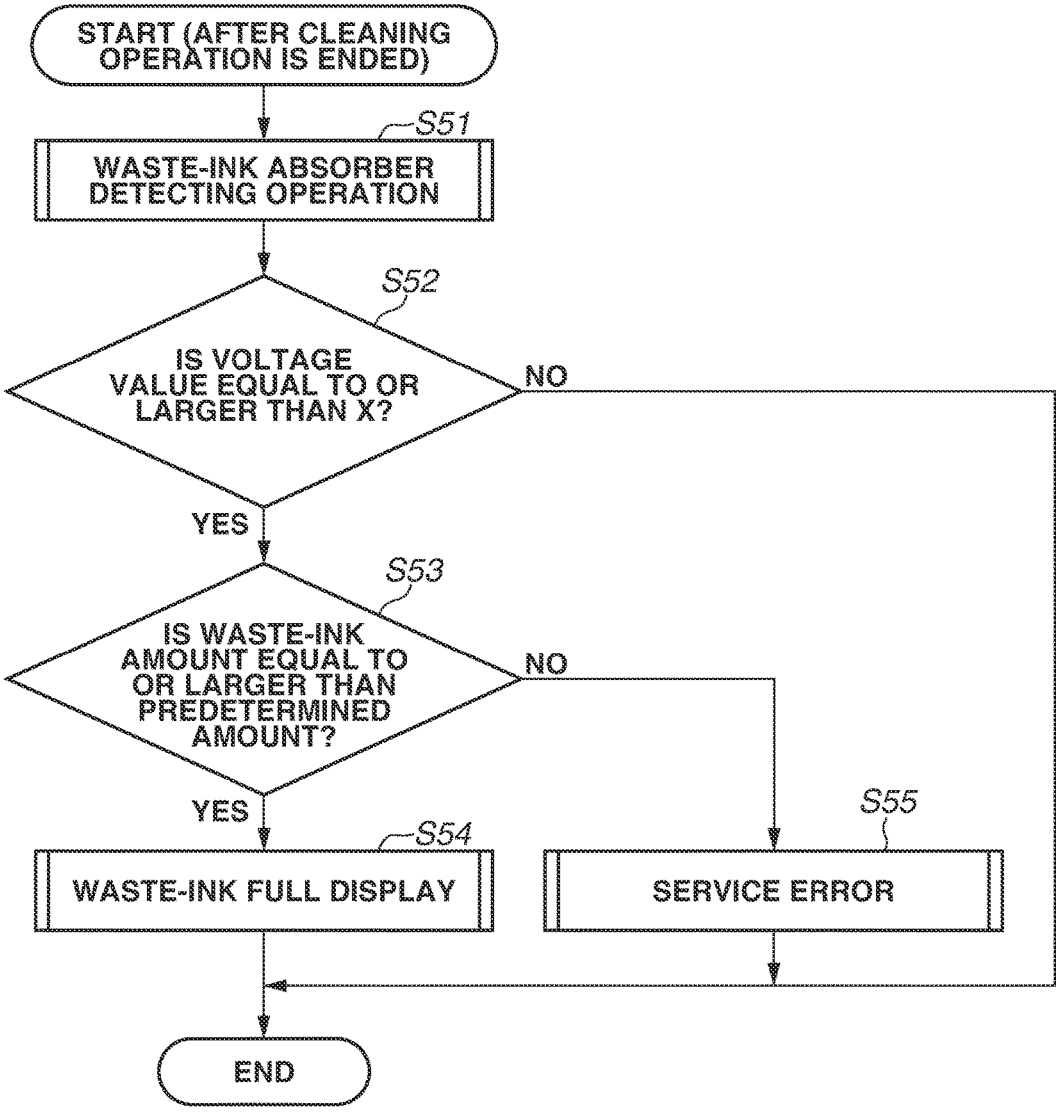
FIG. 17 is a flowchart illustrating control according to the fifth exemplary embodiment.

The control according to the present exemplary embodiment is described with reference to a flowchart of FIG. 17. This control is started after the suction operation (the cleaning operation) by the recovery unit is ended. First, in step S51, the detecting operation by the detection sensor 200 is performed on the waste-ink absorber 505. In step S52, whether the voltage value as the detection result by the detecting operation in step S51 is equal to or larger than the threshold X (v) is determined. In a case where it is determined that the voltage value is equal to or larger than the threshold X (v) (YES in step S52), the processing proceeds to next step S53. In step S53, whether the waste ink amount in the waste-ink storage unit, stored in the non-volatile memory 1005, is equal to or larger than a predetermined amount is determined. For example, an amount corresponding to a capacity of the waste-ink storage unit is set as the predetermined amount. In a case where it is determined that the waste ink amount equal to or larger than the predetermined amount in step S53 (YES in step S53), it is estimated that the intensity of the regularly-reflected light on the waste-ink absorber 505 is changed because the waste-ink storage unit 504 is filled with the ink as illustrated in FIG. 16B. Accordingly, the processing proceeds to step S54, and the full state of the waste-ink storage unit 504 is displayed on an unillustrated operation display unit, the host apparatus, or the like, thereby prompting a user to replace the waste-ink storage unit 504.

On the other hand, in a case where it is determined that the waste ink amount is lower than the predetermined amount in step S53 (NO in step S53), the processing proceeds to step S55 and service error that is not recovered by the user is displayed on the operation display unit, the host apparatus, or the like. This is because when higher intensity of the regularly-reflected light on the waste-ink absorber 505 is detected even though the waste ink amount does not reach the predetermined amount, for example, failure of the detection sensor or the like is considered as a cause, and replacement of the detection sensor or the like is accordingly necessary.

Figure 16C:
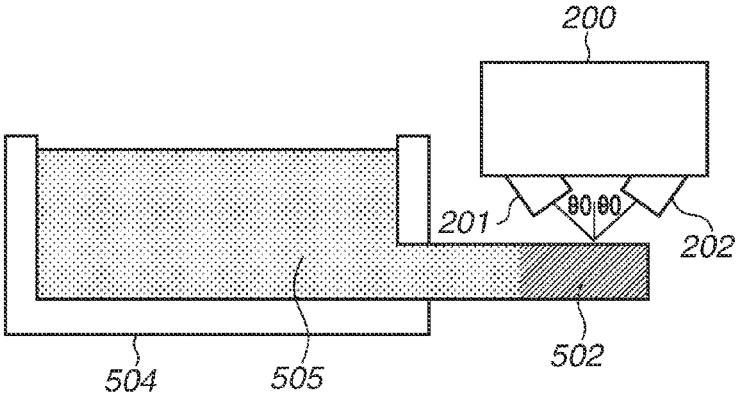

In addition, in a case where the ink is placed under environment with low humidity that causes the ink to be easily solidified, in a case where a user uses ink that is particularly easily solidified, or the like, the ink may be solidified inside the waste-ink absorber. For example, the ink may be solidified near a connection part between the waste-ink storage unit 504 and the tube 502, which may cause ink clogging. To address this issue, as illustrated in FIG. 16C, the detection sensor 200 may be disposed near a boundary between the waste-ink absorber 505 and the tube 502 to measure the intensity of the regularly-reflected light on the waste-ink absorber 505, and thereby detect the solidification of the ink. In a case where the ink clogging occurs in this configuration, the voltage value becomes equal to or larger than the threshold in step S52 but the waste ink amount becomes lower than the predetermined amount in step S53 in the control of FIG. 17. Accordingly, service error is displayed on the operation display unit or the like in step S55.

As described above, according to the present exemplary embodiment, performing the detecting operation by the detection sensor is performed on the waste-ink absorber allows the user to accurately grasp replacement time of the waste-ink pack and the like. In addition, it is possible to detect failure of the detection sensor, solidification in a flow path of the waste-ink pack, and the like.

Next, a sixth exemplary embodiment of the present disclosure is described with reference to the drawings. Description of a component similar to that of any of the above-described embodiments is omitted.

Figure 18A:
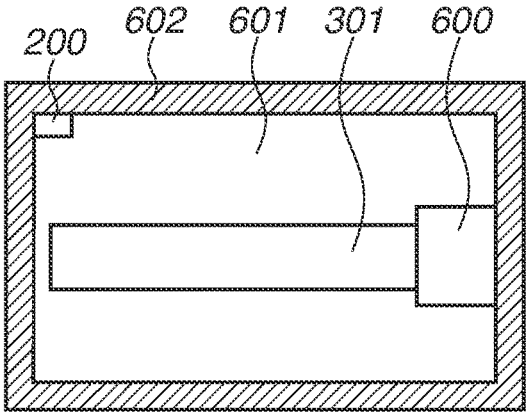
FIGS. 18A, 18B, and 18C are schematic diagrams each illustrating an inkjet printing apparatus according to a sixth exemplary embodiment.
Figure 18B:
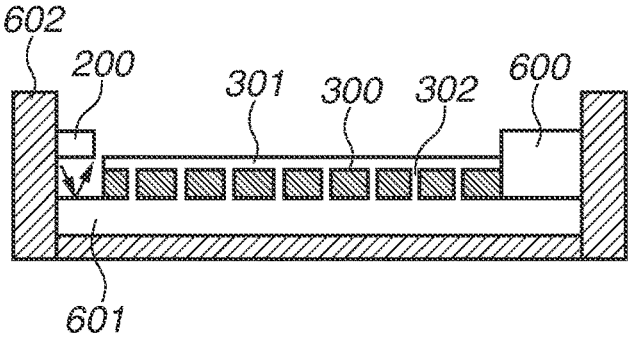
Figure 18C:
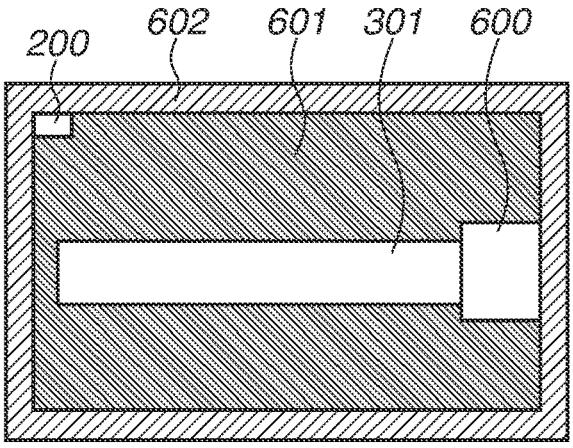

FIGS. 18A, 18B, and 18C are schematic diagrams each illustrating a printing apparatus according to the present exemplary embodiment. FIGS. 18A, 18B, and 18C are schematic diagrams each simply illustrating the printing apparatus illustrated in FIG. 1 from which the carriage, the motor, the conveying mechanism, and the like are removed. FIG. 18A is a plan view of the printing apparatus, and FIG. 18B is a front view of the printing apparatus. In FIGS. 18A, 18B, and 18C, the platen absorber 301 is provided to extend in the moving direction of the unillustrated carriage. A communication port 302 is provided on the platen 300 at a position corresponding to the ejection position at which the ink is ejected to the outside of the printing medium in the marginless printing and corresponding to the ejection position at which the ink is ejected in the preliminary ejection. A waste-ink absorber (an ink absorber) 601 is provided below the platen 300. The waste-ink absorber 601 is spread over the entire region of the bottom part of the printing apparatus. The ink ejected on the platen absorber 301 moves to the waste-ink absorber 601 below the platen 300 through the communication port 302. In addition, a recovery unit 600 includes a cap that covers an ejection port surface of the printing head, similarly to the recovery unit described with reference to FIG. 12 in the second exemplary embodiment. The cap communicates with the suction pump and the waste-ink absorber 601 through a tube. When the suction pump is driven, the ink is sucked from the printing head and the sucked ink is discharged to the waste-ink absorber 601. A housing 602 covers the periphery of the printing apparatus. The detection sensor 200 is disposed at a corner of the housing 602. The detection sensor 200 has a configuration similar to the configuration of any of the above-described exemplary embodiments. In the present exemplary embodiment, the detection sensor 200 emits light to the waste-ink absorber 601 and receives regularly-reflected light.

Figure 19:
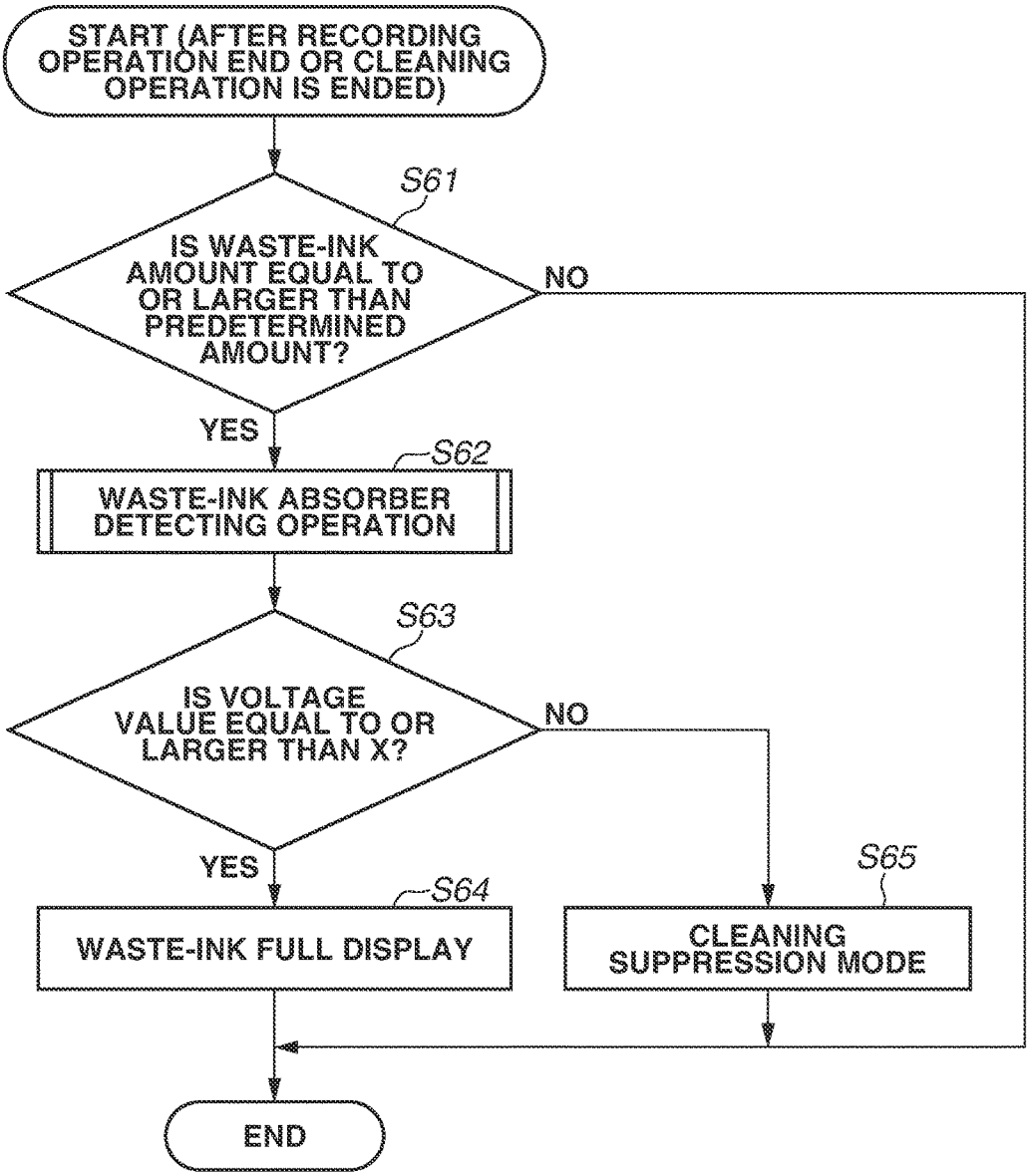
FIG. 19 is a flowchart illustrating control according to the sixth exemplary embodiment.

The control according to the present exemplary embodiment is described with reference to a flowchart of FIG. 19. This control is started after the printing operation or the cleaning operation is ended. First, in step S61, whether the waste ink amount in the waste-ink absorber 601, stored in the non-volatile memory 1005, is equal to or larger than a predetermined amount is determined, similarly to step S53 in FIG. 17. For example, a limit amount of the ink held by the waste-ink absorber 601 is set as the predetermined amount. In a case where it is determined that the waste ink amount is equal to or larger than the predetermined amount in step S61 (YES in step S61), the processing proceeds to step S62 and the detecting operation by the detection sensor 200 is performed on the waste-ink absorber 601. In next step S63, whether the voltage value as the detection result of the detecting operation in step S62 is equal to or larger than the threshold X (v) is determined. In a case where it is determined that the voltage value is equal to or larger than the threshold X (v) in step S63 (YES in step S63), it is estimated that the ink is spread throughout the waste-ink absorber 601 and the intensity of the regular reflection of the surface of the waste-ink absorber 601 is changed, as illustrated in FIG. 18C. In this state, overflow of the ink from the waste-ink absorber 601 may have occurred. Accordingly, the processing proceeds to step S64 and the full state of the waste-ink absorber is displayed on the operation display unit, the host apparatus, or the like.

On the other hand, in case where it is determined that the voltage value is lower than the threshold X (v) in step S63 (NO in step S63), the processing proceeds to step S65. At this time, it is determined that the waste ink amount is equal to or larger than the predetermined amount in step S61 but it is determined that the voltage value is lower than the threshold X (v) in step S63, and overflow of the ink from the waste-ink absorber 601 has not occurred. The state is estimated as a state in which moisture is evaporated from the ink of the waste-ink absorber and the retention capacity of the waste-ink absorber is slightly increased. It is estimated, however, that the capacity for housing the ink discharged along with the suction operation is not remained. Accordingly, in step S65, a mode (a cleaning suppression mode) that suppresses the suction operation is set. The cleaning suppression mode is a mode in which the suction operation is not performed even at the predetermined timing, or the number of times of suction and the suction amount in the suction operation are reduced. Setting such a mode makes it possible to reduce the ink amount discharged to the waste-ink absorber, and to extend a usable period of the waste-ink absorber.

In the present exemplary embodiment, it may be estimated whether the waste-ink absorber is temporarily filled with the ink or in the full state, by waiting for the predetermined time after the detecting operation, and performing the detecting operation again.

Next, a seventh exemplary embodiment according to the present disclosure is described with reference to the drawings. Description of a component similar to that of any of the above-described exemplary embodiments is omitted.

Figure 20A:
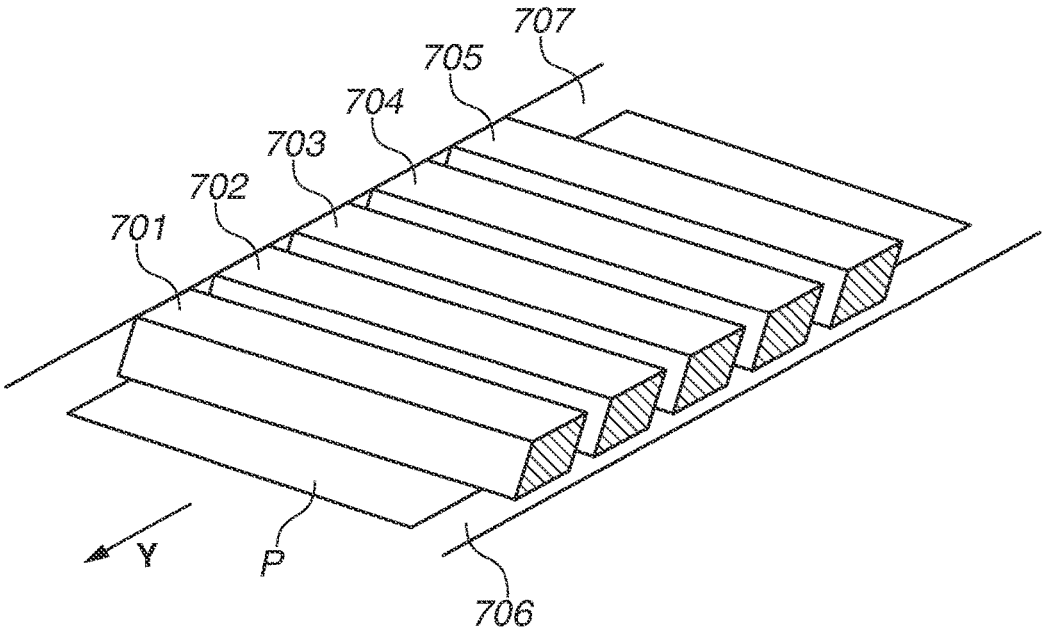
FIGS. 20A and 20B are schematic diagrams each illustrating a printing head according to a seventh exemplary embodiment.
Figure 20B:
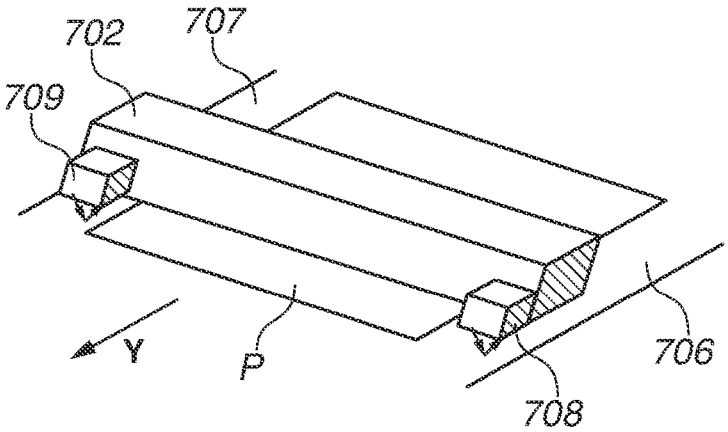

FIGS. 20A and 20B are schematic diagrams each illustrating a printing head according to the present exemplary embodiment. A printing apparatus according to the present exemplary embodiment is a full-line printing apparatus, and includes a line printing head that can eject ink over a full width range of the printing medium P. The line printing head includes an ejection port surface on which a plurality of ejection ports through which the ink is ejected are arranged along a direction intersecting a conveyance direction (the Y direction) of the printing medium P. As illustrated in FIG. 20A, the printing apparatus according to the present exemplary embodiment includes line printing heads (701 to 707) each ejecting ink of a corresponding color. In FIG. 20A, the line printing heads 701 to 705 respectively eject clear ink, cyan (C) ink, magenta (M) ink, yellow (Y) ink, and black (K) ink. The printing medium P is conveyed by a conveyance belt that comes into contact with the lower part (a rear surface) of the printing medium P and is moved together with the printing medium P in the Y direction by being rotated by an unillustrated driving mechanism. The line printing heads (701 to 707) of the respective colors eject corresponding ink to the printing medium P conveyed in the Y direction to form an image on the printing medium P. Ink absorbers 706 and 707 are provided at respective positions to absorb the ink that is ejected by the line printing heads (701 to 707) to the outside of the printing medium, on the conveyance belt.

FIG. 20B is a diagram illustrating a part of one printing head in FIG. 20A in an enlarged manner. Each of detection sensors 708 and 709 has a configuration similar to the configuration of any of the above-described exemplary embodiments. The detection sensors 708 and 709 are provided on the printing head 702 that ejects the cyan (C) ink, or on an unillustrated head holder that holds the printing head 702. The detection sensors 708 and 709 are provided on downstream side in the printing head 702 in the conveyance direction of the printing medium P. In other words, the detection sensors 708 and 709 are provided between the printing head 702 that ejects the cyan (C) ink and the printing head 701 that ejects the clear ink. The detection sensor 708 includes a light emitting portion that emits light to an ink absorber 706 and a light receiving portion that receives regularly-reflected light from the ink absorber 706. Further, the detection sensor 709 includes a light emitting portion that emits light to an ink absorber 707 and a light receiving portion that receives regularly-reflected light from the ink absorber 707. The detection sensors 708 and 709 detects intensity (glossiness) of the regularly-reflected light, thereby detecting deposition or overflow of the ink on the respective ink absorbers 706 and 707, as with the above-described exemplary embodiments.

Figure 21:
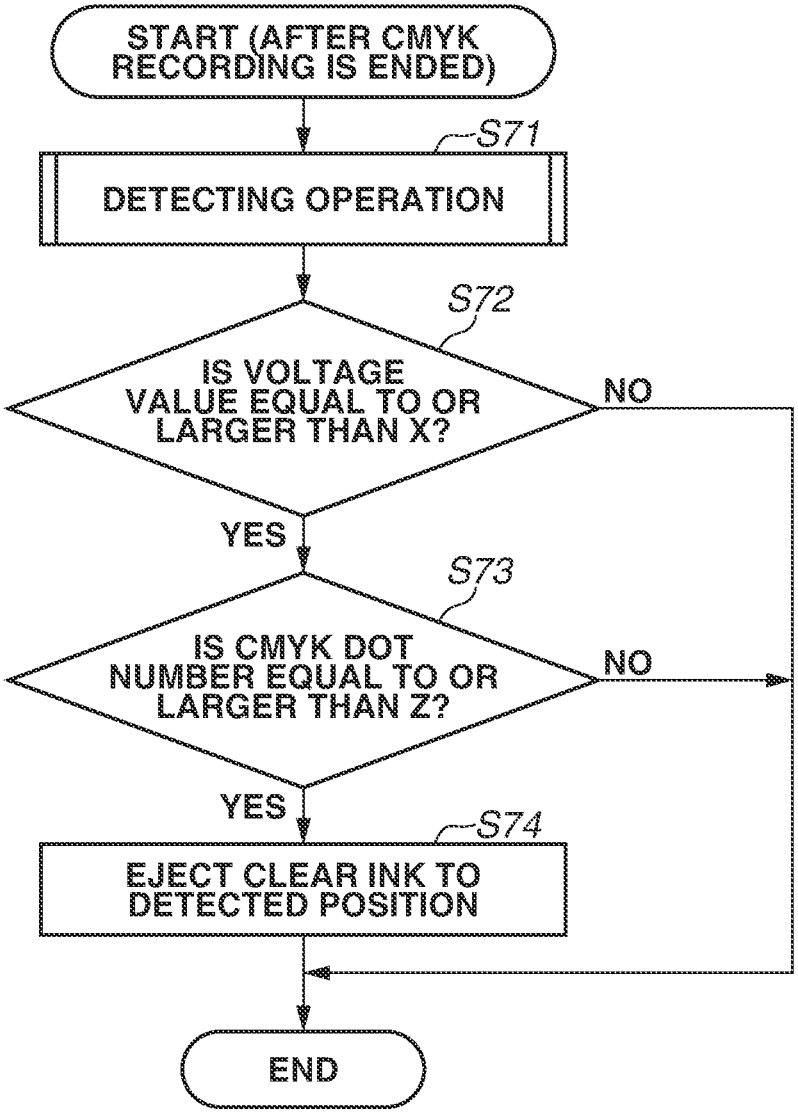
FIG. 21 is a flowchart illustrating control according to the seventh exemplary embodiment.

The control according to the present exemplary embodiment is described with reference to a flowchart of FIG. 21. This control is started after the printing operation by the ink of C, M, Y, and K. First, in step S71, the detecting operation by the detection sensors 708 and 709 is respectively performed on the ink absorbers 706 and 707. In step S72, whether the voltage value as the detection result in the detecting operation is equal to or larger than the threshold X is determined. In a case where it is determined that the voltage value is equal to or larger than the threshold X (v) (YES in step S72), the processing proceeds to step S73. In step S73, the CPU calculates the total dot number (the total ink amount) of the ink of C, M, Y, and K ejected to the outside of the printing medium. In a case where the total dot number is equal to or larger than a predetermined value Z (YES in step S73), it is estimated that the deposition has occurred, and the processing proceeds to step S74. In step S74, the printing head 701 ejects the clear ink serving as the deposition suppression ink to the detected position at which the voltage value detected in the detecting operation is equal to or larger than the threshold X (v). The deposition suppression ejection operation makes it possible to suppress deposition of the ink at the detected position on the ink absorber. The deposition suppression ejection operation may be performed at a time when the clear ink is ejected to the printing medium P immediately after the printing operation by the ink of C, M, Y, and K, or may be performed after the clear ink is ejected to the printing medium P and the conveyance belt then rotates.

In the present exemplary embodiment, the detection sensors 708 and 709 are provided between the printing head 702 that ejects the cyan (C) ink and the printing head 701 that ejects the clear ink. The present disclosure, however, is not limited to the above-described configuration, and for example, a detection sensor may be provided on each of the printing heads and each of the detection sensors may perform the detecting operation. The detection sensor may be disposed not only on the printing head and the head holder but also at an optional position inside the printing apparatus. For example, the detection sensor may be provided on the downstream side in the printing head in the conveyance direction of the printing medium, and it may be confirmed whether deposition of the ink is suppressed through the deposition suppression control. Various control may be performed depending on the position of the detection sensor provided in the above-described manner.

As described above, the present disclosure makes it possible to provide the inkjet printing apparatus that early estimates the state of the ink absorber through the simple configuration.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-213533, filed Oct. 31, 2016, which is hereby incorporated by reference herein in its entirety.

What is claimed is:

1. A printing apparatus comprising:

a printing head configured to eject a first ink and a second ink, wherein the second ink generates less deposition than the first ink;

an ink absorber configured to absorb the ink ejected from the printing head;

a detection unit configured to detect a state of the ink absorber through an optical method;

a control unit configured to cause the printing head to eject the second ink to the ink absorber based on a detection result of the detection unit; and a humidity sensor configured to measure humidity of an environment in which the printing apparatus is placed, wherein the detection unit determines whether or not to perform detection of the state of the ink absorber based on the humidity measured by the humidity sensor.

2. The printing apparatus according to claim 1, wherein the detection unit includes a sensor including a light emitting portion, which emits light toward the ink absorber, and a light receiving portion, which receives light reflected by the ink absorber, and detects the state of the ink absorber based on a quantity of light received by the light receiving portion.

3. The printing apparatus according to claim 2, wherein the sensor receives, with the light receiving portion, the light that has been emitted from the light emitting portion and has been regularly reflected by the ink absorber.

4. The printing apparatus according to claim 2, wherein, in a case where the quantity of the light received by the light receiving portion is larger than a threshold, the control unit causes the printing head to eject an ejection amount of the second ink to the ink absorber, the ejection amount of the second ink being determined based on an ejection amount of the first ink.

5. The printing apparatus according to claim 2, wherein, in a case where the quantity of the light received by the light receiving portion is larger than a threshold, the detection unit estimates that the ink absorber is in an abnormal state.

6. The printing apparatus according to claim 2, wherein, in a case where the quantity of the light received by the light receiving portion is larger than a threshold, the detection unit estimates that deposition or overflow of the ink has occurred on the ink absorber.

7. The printing apparatus according to claim 6, wherein, in the case where the quantity of the light received by the light receiving portion is larger than the threshold, the detection unit estimates that deposition of the ink has occurred on the ink absorber when an amount of the ink ejected from the printing head to the ink absorber is equal to or larger than a predetermined amount, and the detection unit estimates that overflow of the ink has occurred on the ink absorber when the amount of the ink is lower than the predetermined amount.

8. The printing apparatus according to claim 7, wherein, in a case where the detection unit estimates that deposition of the ink has occurred on the ink absorber, the control unit displays a warning for a user.

9. The printing apparatus according to claim 7, wherein, in a case where the detection unit estimates that overflow of the ink has occurred on the ink absorber, the control unit waits for a predetermined time before next printing operation is started.

10. The printing apparatus according to claim 7, wherein, in a case where the detection unit estimates that overflow of the ink has occurred on the ink absorber, the control unit waits for a predetermined time during next printing operation.

11. The printing apparatus according to claim 2, further comprising a carriage that is mounted with the printing head and is configured to move in a direction intersecting a conveyance direction of a printing medium, wherein the sensor is provided to the carriage.

12. The printing apparatus according to claim 2, wherein, in a case where the quantity of the light received by the light receiving portion is larger than a threshold, the detection unit detects the state of the ink absorber again after waiting for a predetermined time, and the detection unit estimates that deposition or overflow of the ink has occurred on the ink absorber in a case where the quantity of the light received by the light receiving portion in the detection performed again is larger than the threshold.

13. The printing apparatus according to claim 1, wherein the printing head performs marginless printing in which the ink is also ejected to a position outside a printing medium to print an image, and wherein the ink absorber receives the ink ejected to the position outside the printing medium in the marginless printing.

14. The printing apparatus according to claim 1, wherein the printing head performs preliminary ejection operation, and wherein the ink absorber receives ink ejected in the preliminary ejection operation.

15. The printing apparatus according to claim 1, wherein the detection unit detects the state of the ink absorber after printing operation is ended.

16. The printing apparatus according to claim 1, further comprising:

a platen configured to support a conveyed printing medium from below, wherein the ink absorber is provided in the platen.

17. The printing apparatus according to claim 1, wherein the first ink is magenta ink, cyan ink, yellow ink, black ink, or red ink, and wherein the second ink is light cyan ink, light magenta ink, or clear ink.

18. The printing apparatus according to claim 1, further comprising: an acquisition unit configured to acquire information on a number of dots of the ink ejected to the ink absorber, wherein the detection unit determines whether or not to perform the detection of the state of the ink absorber further based on the information.

19. The printing apparatus according to claim 18, wherein the detection unit does not perform the detection of the state of the ink absorber in a case where the humidity measured by the humidity sensor is greater than a predetermined value and where the number of dots of the ink ejected to the ink absorber within predetermined time, acquired by the acquisition unit, is less than a predetermined number of dots.

20. The printing apparatus according to claim 18, wherein the detection unit performs the detection of the state of the ink absorber in a case where the humidity measured by the humidity sensor is not greater than a predetermined value and where a deposition dot number is not less than a predetermined value, wherein the deposition dot number is a number of dots calculated by subtracting a number of dots of the second ink ejected to the ink absorber from a number of dots of the first ink ejected to the ink absorber.

* * * * *